US005798780A

United States Patent [19]

Koizumi et al.

[11] Patent Number: 5,798,780

[45] Date of Patent: Aug. 25, 1998

[54] RECORDING ELEMENT DRIVING UNIT HAVING EXTRA DRIVING ELEMENT TO FACILITATE ASSEMBLY AND APPARATUS USING SAME

[75] Inventors: Yutaka Koizumi, Tokyo; Yasutomo Watanabe, Machida, both of Japan

[73] Assignee: Canon Kabushiki Kaisha, Tokyo, Japan

[21] Appl. No.: 481,209

[22] Filed: Jun. 7, 1995

Related U.S. Application Data

[63] Continuation of Ser. No. 114,250, Sep. 1, 1993, abandoned, which is a continuation of Ser. No. 687,079, Apr. 18, 1991, abandoned, which is a continuation of Ser. No. 373,998, Jun. 30, 1989, abandoned.

[30] Foreign Application Priority Data

| | | | |
|---|---|---|---|
| Jul. 3, 1988 | [JP] | Japan | 63-165386 |
| Jul. 6, 1988 | [JP] | Japan | 63-168194 |
| Jul. 11, 1988 | [JP] | Japan | 63-172294 |
| Jul. 11, 1988 | [JP] | Japan | 63-172295 |
| Jul. 22, 1988 | [JP] | Japan | 63-182879 |
| Jan. 9, 1989 | [JP] | Japan | 1-002273 |

[51] Int. Cl.[6] ..... B41J 2/05; H01R 9/09

[52] U.S. Cl. ..... 347/50; 347/58; 437/91

[58] Field of Search ..... 347/50, 58; 439/66, 439/91

[56] References Cited

U.S. PATENT DOCUMENTS

| | | | |
|---|---|---|---|
| 3,403,438 | 10/1968 | Best | 228/180.2 X |
| 3,680,037 | 7/1972 | Nellis | 439/66 X |
| 3,862,790 | 1/1975 | Davies | 439/66 |
| 4,003,621 | 1/1977 | Lamp | 439/66 X |
| 4,199,637 | 4/1980 | Sado | 428/119 |
| 4,201,435 | 5/1980 | Nakamura | 439/91 X |
| 4,209,481 | 6/1980 | Kashiro | 439/91 X |
| 4,499,478 | 2/1985 | Matsufujii | 347/49 |
| 4,577,918 | 3/1986 | Kasdagly | 439/66 |
| 4,635,073 | 1/1987 | Hanson | 347/50 |
| 4,636,813 | 1/1987 | Mego | 346/76 PH |
| 4,664,309 | 5/1987 | Allen | 228/180.2 |
| 4,698,644 | 10/1987 | Drago | 347/50 X |
| 4,711,548 | 12/1987 | Arakawa | 439/66 X |
| 4,723,129 | 2/1988 | Endo | 347/56 |
| 4,729,166 | 3/1988 | Lee et al. | 29/877 |
| 4,740,800 | 4/1988 | Kyoshima | 347/67 |
| 4,764,659 | 8/1988 | Minami | 346/76 PH X |
| 4,806,947 | 2/1989 | Uegeais | 346/76 PH |
| 4,808,112 | 2/1989 | Wood | 439/66 |
| 4,873,622 | 10/1989 | Komuro | 347/50 |
| 4,926,549 | 5/1990 | Yoshizawa | 174/262 X |
| 5,058,800 | 10/1991 | Yoshizawa | 228/180.2 |

FOREIGN PATENT DOCUMENTS

| | | | |
|---|---|---|---|
| 61-110492 | 5/1986 | Japan | H05K 3/36 |
| 63-299065 | 12/1988 | Japan . | |

*Primary Examiner*—Joseph W. Hartary

*Attorney, Agent, or Firm*—Fitzpatrick, Cella, Harper & Scinto

[57] ABSTRACT

A recording element driving unit has an electrical connecting member having a support member of electrically insulating material and electroconductive members arranged on the support member. Each electroconductive member has one end exposed on one surface of the support member and another end exposed on another surface of the support member. A recording element substrate having recording elements is connected to one exposed end of at least one electroconductive member. A driving element substrate has driving elements thereon, and each driving element has connecting portions. The driving elements are larger in number than a number of driving elements electrically connected to the recording elements and are fewer in number than the electroconductive members. The driving element connecting portions are disposed at a pitch larger than a pitch at which the electroconductive members are arranged, and each driving element connecting portion is connected to the other exposed end of at least one electroconductive member.

24 Claims, 16 Drawing Sheets

RECORDING ELEMENT DRIVING UNIT HAVING EXTRA DRIVING ELEMENT TO FACILITATE ASSEMBLY AND APPARATUS USING SAME

This application is a continuation of application Ser. No. 08/114,250 filed Sep. 1, 1993, now abandoned, which in turn is a continuation of application Ser. No. 07/687,079 filed Apr. 18, 1991, now abandoned, which in turn is a continuation application Ser. No. 07/373,998 filed Jun. 30, 1989, now abandoned.

BACKGROUND OF THE INVENTION

1. Field of the Invention

This invention relates to a recording element unit, and a recording element driving unit, an ink jet unit, an ink jet driving unit and an ink jet device using the same.

2. Related Background Art

There have been known the following prior art techniques for constituting the recording element substrate and the driving element substrate by electrical connection.

(1) Wire bonding method:

This method is a method in which a recording element substrate is fixed and supported on a driving element substrate by use of Ag paste, etc., and then the connecting portion of the recording element substrate and the desired connecting portion of the recording element substrate are electrically connected by use of a very fine metal wire such as of gold, etc.

That is, this method, as shown in FIGS. 1A and 1B, is a method in which the electrodes 14, 15 of the recording element substrate 4 are electrically connected to the desired electrode of the driving element substrate by use of a very fine metal wire 16 such as of gold, etc.

(2) The method in which the recording elements and the driving elements are formed on an integral substrate:

This method, as shown in the equivalent circuit diagram in FIG. 2, is a method in which the recording elements 603 and the driving elements 101 are formed on an integral substrate 900 according to a suitable film forming technique.

However, the electrical connecting methods of the prior art have the following problems.

(1) Wire bonding method:

(a) In the wire bonding method, for avoiding contact mutually between the adjacent very fine metal wires, etc., some intervals must be taken as the pitch dimension of the connecting portions (distance between the centers of the adjacent connecting portions) on the driving elements. Accordingly, when the size of the driving element is determined, the maximum number of the connecting portions will be necessarily determined. Whereas, in the wire bonding method, because the pitch dimension is as large as about 0.2 mm, the number of the connecting portions must but be made smaller.

This means on the contrary that when the number of the connecting portions of the driving element or the recording element is determined, the size of the driving element substrate and the recording element substrate must be made very long.

(b) The height h of the very fine metal wire measured from the connecting portion on the driving element is generally 0.2 to 0.4 mm, and since it is relatively difficult to make the thickness thinner than 0.2 mm, it is impossible to effect thinning.

(c) It takes a lot of time for wire bonding working. Particularly when the bonding point number is increased, the bonding time becomes longer to worsen production efficiency.

(d) If the transfer molding conditions are surpassed by some factors, the very fine metal wire may be deformed or cut in the worst case.

Also, at the connecting portion on the driving element, since Al is exposed which cannot be formed into an alloy with the very fine metal wire, corrosion of Al is liable to occur, whereby reliability is lowered.

(e) When the driving element becomes bad, it is difficult to exchange only the driving element.

(2) The method of forming the recording element and the driving element on an integral substrate:

In this method, there is involved the problem that if a problem occurs in either part of the recording element or the driving element, the device as a whole will no longer be actuated.

SUMMARY OF THE INVENTION

The present invention provides a recording element unit, a recording element driving unit, an ink jet unit and an ink jet driving unit provided with electrical connecting members capable of solving the problems as described above, arranging a large number of connecting portions of recording elements and driving elements at high density, and therefore accomplishing miniaturization of even lengthy units easily.

Such invention is a recording element unit comprising:

an electrical connecting member having a holding member formed by use of an electrically insulating material and a plurality of electroconductive members arranged on said holding member, with one end of said electroconductive member being exposed on one surface of said holding member and the other end of said electroconductive member being exposed on the other surface of said holding member; and a recording element substrate having a plurality of recording elements more by at least one than the necessary number arranged thereon;

one end of the electroconductive member exposed on one surface of said electrical connecting member being connected to said recording element.

Another aspect of the invention is a recording element driving unit comprising:

an electrical connecting member having a holding member formed by use of an electrically insulating material and a plurality of electroconductive members arranged on said holding member, with one end of said electroconductive member being exposed on one surface of said holding member and the other end of said electroconductive member being exposed on the other surface of said holding member;

a recording element substrate having a recording element arranged thereon; and a driving element substrate having a driving element having connecting portions of at least one more than the necessary number arranged thereon, one end of the electroconductive member exposed on one surface of said electrical connecting member being connected to said recording element;

the other end of the electroconductive member exposed on the other surface of said electrical connecting member being connected to the connecting portion of said driving element.

Still another invention is an ink jet unit comprising:

an electrical connecting member having a holding member formed by use of an electrically insulating material and a plurality of electroconductive members arranged on said holding member, with one end of said electroconductive member being exposed on one surface of said holding member and the other end of said electroconductive member being exposed on the other surface of said holding member; and a recording element substrate having a plurality of recording elements of at least one more than the necessary number arranged thereon;

said recording element substrate having a liquid pathway communicated to a discharging opening for discharging ink formed thereon.

Still another invention is an ink jet driving unit comprising:

an electrical connecting member having a holding member formed by use of an electrically insulating material and a plurality of electroconductive members arranged on said holding member, with one end of said electroconductive member being exposed on one surface of said holding member and the other end of said electroconductive member being exposed on the other surface of said holding member;

a recording element substrate having a plurality of recording elements arranged thereon; and a driving element substrate having a driving element having connecting portions more by at least one than the necessary number arranged thereon, said recording element substrate having a liquid pathway communicated to a discharging opening for discharging ink formed thereon;

one end of the electroconductive member exposed on one surface of said electrical connecting member being connected to said recording element;

the other end of the electroconductive member exposed on the other surface of said electrical connecting member being connected to the connecting portion of said driving element, and also an ink jet device having said ink jet driving unit and a means for mounting said ink jet driving unit.

Still another invention is a recording element driving unit comprising:

a plurality of electrical connecting members each having a holding member formed by use of an electrically insulating material and a plurality of electroconductive members arranged on said holding member, with one end of said electroconductive member being exposed on one surface of said holding member and the other end of said electroconductive member being exposed on the other surface of said holding member;

a recording element substrate having a plurality of recording elements arranged thereon; and a driving element substrate having a plurality of driving elements arranged thereon;

a base member for arranging said recording element substrate and said driving element substrate;

a circuit substrate to which said recording element substrate is connected through a first one of said electrical connecting members and said driving element unit is connected through a second one of said electrical connecting members on the surface where a wiring pattern is formed; and a pressure contact member for pressure contacting said circuit substrate with said recording element substrate, and said circuit substrate with said driving element substrate, respectively through said electrical connecting members.

Still another invention is an ink jet driving unit comprising:

a plurality of electrical connecting members each having a holding member formed by use of an electrically insulating material and a plurality of electroconductive members arranged on said holding member, with one end of said electroconductive member being exposed on one surface of said holding member and the other end of said electroconductive member being exposed on the other surface of said holding member;

a recording element substrate having a plurality of recording elements arranged thereon; and a driving element substrate having a plurality of driving elements arranged thereon;

a base member for arranging said recording element substrate and said driving element substrate;

a circuit substrate to which said recording element substrate is connected through a first one of said electrical connecting members and said driving element substrate is connected through a second one of said electrical connecting members on the surface where a wiring pattern is formed; and a pressure contact member for pressure contacting said circuit substrate with said recording element substrate, and said circuit substrate with said driving element substrate, respectively through said electrical connecting members, said recording element substrate having a liquid pathway communicated to a discharging opening for discharging ink formed thereon, and also an ink jet recording device provided with said ink jet driving unit and a means for mounting said ink jet driving unit.

Still another invention is a recording element driving unit comprising:

a plurality of electrical connecting members each having a holding member formed by use of an electrically insulating material and a plurality of electroconductive members arranged on said holding member, with one end of said electroconductive member being exposed on one surface of said holding member and the other end of said electroconductive member being exposed on the other surface of said holding member;

a recording element substrate having a plurality of recording elements arranged thereon; and a driving element substrate having a plurality of driving elements arranged thereon;

a circuit substrate for transmitting a driving signal to said driving element substrate;

a base member for arranging said recording element substrate and said driving element substrate; and a pressure contact member for pressure contacting said recording element substrate with said driving element substrate and said circuit substrate with said driving element substrate, respectively through said electrical connecting members, said recording element substrate and said driving element substrate being electrically connected through a first one of said electrical connecting members, and said driving element substrate and said circuit substrate being electrically connected through a second one of said electrical connecting members.

Still another invention is an ink jet driving unit comprising:

a plurality of electrical connecting members each having a holding member formed by use of an electrically insulating material and a plurality of electroconductive members arranged on said holding member, with one end of said electroconductive member being exposed on one surface of said holding member and the other end of said electroconductive member being exposed on the other surface of said holding member;

a recording element substrate having a plurality of recording elements arranged thereon;

a driving element substrate having a plurality of driving elements arranged thereon;

a circuit substrate for transmitting a driving signal to said driving element substrate;

a base member for arranging said recording element substrate and said circuit substrate; and a pressure contact member for pressure contacting said recording element substrate with said driving element substrate and said circuit substrate with said driving element substrate, respectively through said electrical connecting members, said recording element substrate having a liquid pathway communicated to a discharging opening for discharging ink;

said recording element substrate and said driving element substrate being electrically connected through a first one of said electrical connecting members, and said driving element substrate and said circuit substrate being electrically connected through a second one of said electrical connecting members, and an ink jet recording device comprising said ink jet driving unit and a means for mounting said ink jet driving unit.

Still another invention is a recording element unit comprising:

a plurality of electrical connecting members each having a holding member formed by use of an electrically insulating material and a plurality of electroconductive members arranged on said holding member, with one end of said electroconductive member being exposed on one surface of said holding member and the other end of said electroconductive member being exposed on the other surface of said holding member; and a recording element substrate having a plurality of connecting portions and a plurality of recording elements arranged thereon, said plurality of electrical connecting members being arranged on said recording element substrate so that one end of the electroconductive member exposed on one surface of each electrical connecting member may be connected to the connecting portion of said recording element substrate.

Still another invention is a recording element unit comprising:

an electrical connecting member having a holding member formed by use of an electrically insulating material having at least one of one or a plurality of grooves and holes and a plurality of electroconductive members arranged on said holding member, with one end of said electroconductive member being exposed on one surface of said holding member and the other end of said electroconductive member being exposed on the other surface of said holding member; and a recording element substrate having a plurality of connecting portions and a plurality of recording elements arranged thereon, one end of the electroconductive member exposed on one surface of said electrical connecting member being connected to the connecting portion of said recording element substrate.

Still another invention is a recording element driving unit comprising:

a plurality of electrical connecting members each having a holding member formed by use of an electrically insulating material having at least one of one or a plurality of grooves and holes and a plurality of electroconductive members arranged on said holding member, with one end of said electroconductive member being exposed on one surface of said holding member and the other end of said electroconductive member being exposed on the other surface of said holding member; and a recording element substrate having a plurality of connecting portions and a plurality of recording elements arranged thereon, a driving element substrate having a plurality of connecting portions and one or a plurality of driving elements arranged thereon, said plurality of electrical connecting members being arranged on said recording element substrate so that one end of the electroconductive member exposed on one surface of each electrical connecting member may be connected to the connecting portion of said recording element substrate;

the other end of the electroconductive member exposed on the other surface of said each electrical connecting member being connected to the connecting portion of said driving element substrate.

Still another invention is a recording element driving unit comprising:

an electrical connecting member having a holding member formed by use of an electrically insulating material having at least one of one or a plurality of grooves and holes and a plurality of electroconductive members arranged on said holding member, with one end of said electroconductive member being exposed on one surface of said holding member and the other end of said electroconductive member being exposed on the other surface of said holding member;

a recording element substrate having a plurality of connecting portions and a plurality of recording elements arranged thereon; and a driving element substrate having a plurality of connecting portions and one or a plurality of driving elements arranged thereon;

one end of the electroconductive member exposed on one surface of said electrical connecting member being connected to the connecting portion of said recording element substrate, the other end of the electroconductive member exposed on the other surface of said each electrical connecting member being connected to the connecting portion of said driving element substrate.

Still another invention is an ink jet unit comprising:

a plurality of electrical connecting members each having a holding member formed by use of an electrically insulating material and a plurality of electroconductive members arranged on said holding member, with one end of said electroconductive member being exposed on one surface of said holding member and the other end of said electroconductive member being exposed on the other surface of said holding member; and a recording element substrate having a plurality of connecting portions and a plurality of recording elements arranged thereon, said recording element substrate having a liquid pathway communicated to a discharging opening for discharging ink formed thereon, said plurality of electrical connecting members being arranged on said recording element substrate so that one end of the electroconductive member exposed on one surface of each electrical connecting member may be connected to the connecting portion of said recording element substrate.

Still another invention is an ink jet unit comprising:

an electrical connecting member having a holding member formed by use of an electrically insulating material having at least one of one or a plurality of grooves and holes and a plurality of electroconductive members arranged on said holding member, with one end of said electroconductive member being exposed on one surface of said holding member and the other end of said electroconductive member being exposed on the other surface of said holding member; and a recording element substrate having a plurality of connecting portions and a plurality of recording elements arranged thereon, said recording element substrate having a liquid pathway communicated to a discharging opening for discharging ink formed thereon, one end of the electroconductive member exposed on one surface of said electrical connecting member being connected to the connecting portion of said recording element substrate.

Still another invention is an ink jet driving unit comprising:

a plurality of electrical connecting members each having a holding member formed by use of an electrically insulating material and a plurality of electroconductive members arranged on said holding member, with one end of said electroconductive member being exposed on one surface of said holding member and the other end of said electroconductive member being exposed on the other surface of said holding member;

a recording element substrate having a plurality of connecting portions and a plurality of recording elements arranged thereon; and a driving element substrate having a plurality of connecting portions and one or a plurality of driving elements arranged thereon, said recording element substrate having a liquid pathway communicated to a discharging opening for discharging ink formed thereon, said plurality of electrical connecting members being arranged on said recording element substrate so that one end of the electroconductive member exposed on one surface of each electrical connecting member may be connected to the connecting portion of said recording element substrate;

the other end of the electroconductive member exposed on the other surface of said each electrical connecting member being connected to the connecting portion of said driving element substrate, and an ink jet device comprising said ink jet driving unit and a means for mounting said ink jet driving unit.

Still another invention is an ink jet driving unit comprising:

an electrical connecting member having a holding member formed by use of an electrically insulating material having at least one or a plurality of grooves and holes and a plurality of electroconductive members arranged on said holding member, with one end of said electroconductive member being exposed on one surface of said holding member and the other end of said electroconductive member being exposed on the other surface of said holding member; and a recording element substrate having a plurality of connecting portions and a plurality of recording elements arranged thereon, a driving element substrate having a plurality of connecting portions and one or a plurality of driving elements arranged thereon;

said recording element substrate having a liquid pathway communicated to a discharging opening for discharging ink formed thereon, one end of the electroconductive member exposed on one surface of said electrical connecting member being connected to the connecting portion of said recording element substrate, the other end of the electroconductive member exposed on the other surface of said each electrical connecting member being connected to the connecting portion of said driving element substrate, and an ink jet device comprising said ink jet driving unit and a means for mounting said ink jet driving unit. substrate has liquid pathways each communicating with a discharging opening for discharging ink and recording elements for performing recording by discharging ink through the discharging opening. Each recording element is electrically connected to one exposed end of at least one electroconductive member. A driving element substrate has driving elements, each driving element having connecting portions and the driving elements being larger in number than a number of driving elements electrically connected to the recording elements and fewer in number than the electroconductive members. The driving element connecting portions are disposed at a pitch larger than a pitch at which the electroconductive members are arranged. Each driving element connecting portion is connected to the other exposed end of at least one electroconductive member. A means for mounting mounts the recording element driving unit.

DETAILED DESCRIPTION OF THE PREFERRED EMBODIMNETS

Figure 1A:
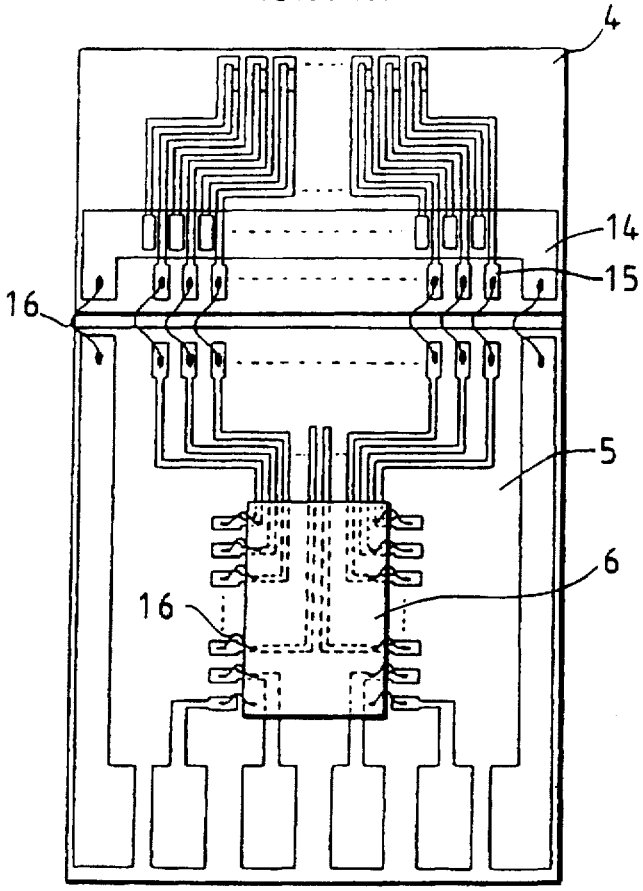
FIG. 1A PRIOR ART
FIGS. 1A and 1B are a schematic top view and a schematic side view for explanation of the connecting method of the prior art mutually between the element substrates, respectively.
Figure 1B:
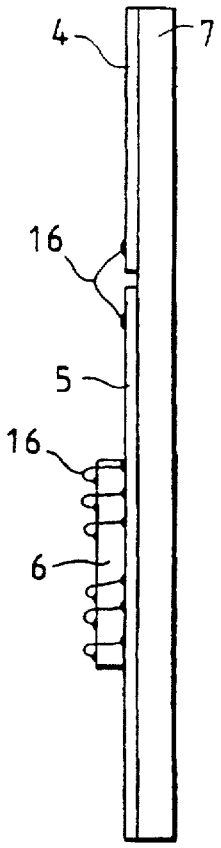
FIG. 1B PRIOR ART
Figure 2:
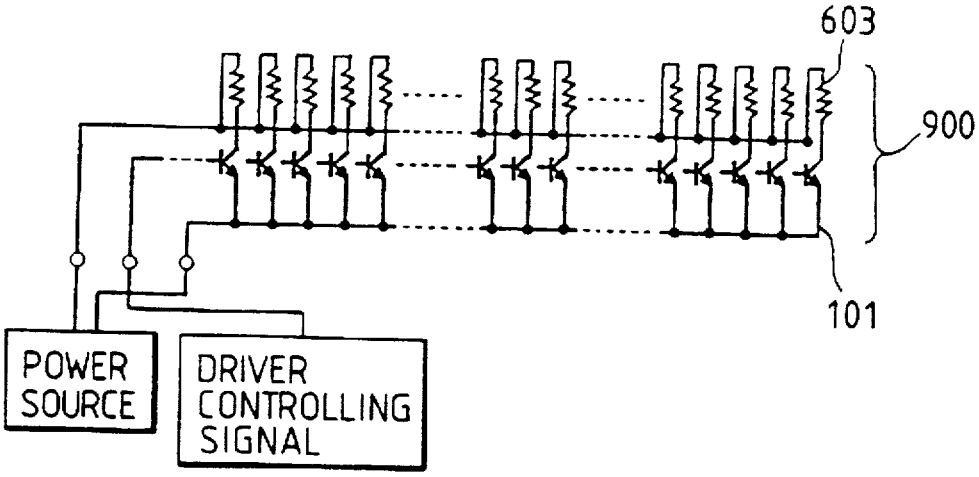
FIG. 2 PRIOR ART
FIG. 2 is an equivalent circuit diagram of the unit of the prior art.

First, the main constituting requirements are to be described.

(Electrical Connecting Member)

The electrical connecting member according to the present invention has a plurality of electroconductive members arranged on a holding member comprising an electrically insulating material. The electroconductive members arranged are electrically separated mutually from each other. Arrangement may be done by, for example, embedding a part of the electroconductive member in the holding member, or according to other methods. For example, without embedding in the holding member, it may be arranged on the surface of the holding member according to a suitable means.

One end of the electroconductive member is exposed on one surface of the holding member, while the other end is exposed on the other surface of the holding member.

When the electroconductive member is arranged only on the surface, on end and the other end may be connected to each other by a suitable wiring.

Further, the electrical connecting member may also comprise one layer or a multi-layer of two or more layers.

When a plurality of electrical connecting members are used according to the present invention, the size of one electrical connecting member and the number of electrical electroconductive members arranged are not particularly limited. This is because these optimum values are determined depending on the pitch of the electroconductive members and thermal expansion coefficient of the holding member, etc.

Similarly, the size, pitch, number, etc. of the groove and/or hole of the electroconductive member provided with groove and/or hole according to the present invention are not also particularly limited.

(Electroconductive Member)

Any electroconductive member exhibiting electrically conductivity may be available. Metal materials are generally employed, but other than metal materials, materials exhibiting superconductivity, etc. may be also employed.

As the material for the metal member, gold is preferred, but any other metal or alloy other than gold can be also used. For example, metals or alloys such as Ag, Be, Ca, Mg, Mo, Ni, W, Fe, Ti, In, Ta, Zn, Cu, Al, Sn, Pb—Sn, etc. may be included.

The metal member and the alloy member may have the same kind of metal or different kinds of metals existing in the same electrical connecting member. Further, one of the metal member and the alloy member of the electrical connecting member may be made of the same kind of metal or alloy or different kinds of metals or alloys. Further, other than metals or alloys, a material including one or both of organic material or inorganic material in a metal material may be also used, provided that it exhibits electroconductivity. Also, a combination of an inorganic material and an organic material which can exhibit electroconductivity may be also used.

Further, the cross-section of the electroconductive member can be made circular, square or other shapes.

The thickness of the electroconductive member is not particularly limited. It may be made, for example, 20 μmϕ or more or 20 μmϕ or less, in view of the pitch of the connecting portions of the electrical circuit part.

The exposed portion of the electroconductive member may be made the same plane as that of the holding member, or protruded from the surface of the holding member. Such protrusion may be either only from one surface or from both surfaces. Further, when protruded, it may be shaped in bump.

The pitch of the electroconductive members should preferably be made smaller than the pitch of the connecting portion of the driving elements. By doing so, the connecting portions of the driving elements can be connected to the electrical connecting members without requiring registration between the connecting portions of the driving elements and the electrical connecting members.

When embedded in the holding member, the electroconductive members are not required to be vertically arranged in the holding member, but may be also made oblique from one surface side of the holding member to the other surface side of the holding member.

(Holding Member)

The holding member comprises an electrically insulating material.

Any electrically insulating material may be available. As the electrically insulating material, organic materials and inorganic materials may be included. Also, metals or alloys applied so treated so that the electroconductive members may be mutually electrically insulated from each other may be also used. Further, in organic materials, one kind or plural kinds of inorganic materials, metal materials and alloy materials shaped in any desired shape such as powder, fiber, plate, rod, sphere, etc. may be also dispersed to be included therein. Further, in inorganic materials, one kind or plural kinds of organic materials, metal materials and alloy materials shaped in any desired shape such as powder, fiber, plate, rod, sphere, etc. may be also dispersed to be included therein. Also, in metal materials, one kind or plural kinds of inorganic materials, organic materials shaped in any desired shape such as powder, fiber, plate, rod, sphere, etc. may be dispersed to be included therein. When the holding member comprises a metal material, for example, an electrically insulating material such as resin, etc. may be arranged between the electroconductive members and the holding member.

Here, as the organic material, for example, insulating resins may be used, and as the resin, any of thermosetting resin, UV-ray curable resin, thermoplastic resin may be used. For example, there can be used polyimide resin, polyphenylene sulfide resin, polyethersulfone resin, polyether imide resin, polysulfone resin, fluorine resin, polycarbonate resin, polydiphenyl ether resin, polybenzylimidazole resin, polyamideimide resin, polypropylene resin, polyvinyl chloride resin, polystyrene resin, methyl methacrylate resin, polyphenylene oxide resin, phenol resin, melanine resin, epoxy resin, urea resin, methacrylic resin, vinylidene chloride resin, alkyd resin, silicone resin and other resins.

If a resin with good thermal conductivity is used from among these resins, it is more preferable because even if the semiconductor element may accumulate heat, the heat can be dissipated through the resin. Further, if a resin having thermal expansion ratio equal or similar to that of the circuit substrate is chosen, and at least one hole or a plurality of bubbles are permitted to exist in the organic material, it becomes possible to further prevent lowering in reliability due to thermal expansion and thermal shrinkage.

Specific examples of metal materials and alloy materials may include metals or alloys such as Ag, Cu, Au, Al, Be, Ca, Mg, Mo, Fe, Ni, Si, Co, Mn, W, Cr, Nb, Zr, Ti, Ta, Zn, Sn, Pb—Sn, etc.

Examples of inorganic materials may include ceramics such as $SiO_2$, $B_2O_3$, $Al_2O_3$, $Na_2O$, $K_2O$, CaO, ZnO, BaO, PbO, $Sb_2O_3$, $As_2O_3$, $La_2O_3$, $ZrO_2$, BaO, $P_2O_5$, $TiO_2$, MgO, SiC, BeO, BP, BN, AlN, $B_4C$, TaC, $TiB_2$, $CrB_2$, TiN, $Si_3N_4$, $Ta_2O_5$, etc., diamond, glass, carbon, boron and other inorganic materials.

(Connection)

As the connection between the end of the electrical connecting member and the connecting portion of the recording element, there are connection by way of metallization and/or alloy formation, and connection by way of other methods than metallization and/or alloy formation.

(Connection By Way of Metallization and/or Alloy Formation)

In the following, connection by way of metalization and/or alloy formation is to be described.

When the electroconductive member to be connected and the connecting portion of the recording element consist of a pure metal of the same kind, the layer formed by metallization has the crystal structure of the same kind as the electroconductive member or the connecting portion. As the method for metallization, for example, the end of the electroconductive member and the connecting portion corresponding to that end may be contacted with each other, followed by heating to an appropriate temperature. In this case, diffusion of atoms, etc. will occur in the vicinity of the contacted portion by heating and the diffused portion becomes the metallized state to form a metal layer.

When the electroconductive member and the connecting portion of the recording element consist of pure metals of different kinds, the connecting layer to be formed consists of an alloy of the both metals. As the method for alloy formation, for example, the end of the electroconductive member and the connecting portion corresponding to that end may be contacted with each other, followed by heating to an appropriate temperature. In this case, diffusion of atoms, etc. will occur in the vicinity of the contacted portion by heating and an alloy layer comprising a solid solution or an intermetallic compound formed in the vicinity of the contacted portion.

When Au is used as the metal member for the electrical connecting member, and Al for the connecting portion of the electrical circuit part, a heating temperature of 200° to 350° C. may be preferred.

When one of the electroconductive member to be connected and the connecting portion of the recording element comprises a pure metal and the other an alloy, or both comprise alloys of the same kind or different kinds, the connecting interface comprises an alloy layer.

Referring to a plurality of electroconductive members in one electrical connecting member, there are included the case when the respective electroconductive members consist of the same kind of metal or alloy, the case when the respective members consist of different kinds of metals or alloys, and other cases, and also concerning one electroconductive member, there are included the case when it consists of the same kind of metal or alloy, the case when it consists of different kinds of metals or alloys, and other cases. In either case, the above metallization or alloy formation is effected. On the other hand, the same is the case for the connecting portion.

The connecting portion of the electroconductive member or the recording element may be a metal or an alloy at the contact portions of both, and other portions may be under the state of, for example, a metal formulated with an inorganic material such as glass, etc., or a metal formulated with an organic material such as a resin, etc.

The surface of the portion to be connected may be also provided with a metal which can be readily formed into an alloy or a plating layer comprising an alloy.

As the heating method, there may be employed, in addition to the thermal pressure adhesion method, the internal heating method such as the sonication heating method, the high frequency induction heating method, the high frequency dielectric heating method, the microwave heating method, etc. and other external heating methods, or alternatively the above heating methods may be also used in combination. In either heating method, the connecting portion is heated directly or indirectly to be connected.

(Connection By Way of Other Methods Than Metallization and/or Alloy Formation)

For effecting connection other than metallization and/or alloy formation as described above, for example, the connecting portion of the recording element substrate and the electroconductive member of the electrical connecting member may be pressed together by a suitable means to effect connection. For example, the electrical connecting member and the recording element may be brought into a fitted state.

As another connecting method, there is the connecting method by use of an adhesive. That is, there is the method in which the recording element substrate and the electroconductive member are connected through adhesion in at least a part thereof excluding the connecting portion.

Also, when the driving element substrate is connected to the other surface of the electrical connecting member, the above conducting method may be used similarly. For connection of the driving element substrate, it is preferable to effect freely detachable connection.

(Freely Detachable Connection)

Among the various connecting means as described above, for the recording element substrate or the driving element substrate which is required to be exchanged, a means which can be connected freely detachably (e.g. connection by pressurization) may be chosen.

Even when connection is effected by metallization and/or alloy formation, the metal layer or the alloy layer for the driving element may be made to have a melting point lower than that of the metal layer or the alloy layer for the recording element. That is, by making such a constitution, if it is heated to a temperature higher than the melting point of the metal layer or the alloy layer for the driving element, and lower than the melting point of the metal layer or the alloy layer for the recording element, only the driving element can be dismantled without exerting bad influence such as damage, etc. on the connecting portion of the recording element. In the present invention, a freely detachable connection also includes such connection.

(Film)

In the present invention, the recording element unit and the ink jet unit have a film covering the surface of the electrical connecting member opposite to the recording element. By having such film, the surface can be protected from contamination such as with dust, etc., and also from oxidation of the electroconductive member exposed at this surface, whereby connection with the driving element can be well effected.

As the film, any film which can effect such action may be available but one comprising an organic material may be preferred. For example, polyethylene films, polyethylene terephthalate films, etc. may be employed. It is preferable to perform covering by such film in preparing the electrical connecting member. Of course, covering may be also done after preparation.

(Recording Element, Driving Element)

As the recording element in the present invention, there may be employed, for example, an element for generating heat energy (heat-generating element) and other recording elements such as piezoelectric elements.

In the recording element unit, the ink jet unit in the present invention, the connecting portions of the recording element are arranged in a number more by at least one than the necessary number. By such arrangement, connection between the electrical connecting members and the recording element substrate can be effected without requiring strict registration.

On the other hand, the connecting portions of the driving element are arranged on the driving element substrate in the necessary number or in a number at least one more than the necessary number.

Thus, by arranging the connecting portion in numbers more than necessary numbers, connection with the electrical connecting member can be done surely without performing registration or by performing it without accompaniment of so high precision.

(Respective Units)

The recording element unit in the present invention has the electrical connecting member and the recording element substrate, and the ink jet unit is constituted of the above recording element unit having a liquid pathway formed on the recording element substrate. The shape, dimension, etc. of the liquid pathway may be any desired ones.

By respectively providing a driving element substrate on the above recording element unit and the ink jet unit, the recording element driving unit and the ink jet driving unit are formed, respectively.

(Ink Jet Device)

The ink jet device according to the present invention has the above ink jet driving unit and a means for mounting the ink jet driving unit. The type of the ink jet device may be either the so called serial scanning type (printing is performed while the print head moves reciprocally in the lateral direction relative to paper) or the full line type (a print head of one line in the lateral direction is used). Particularly, in the present invention, since the effect is exhibited in a lengthy ink jet driving unit, the full line type is preferred.

In the present invention, since connection with the recording element or the driving element is effected by use of the electrical connecting member as described above, it becomes possible to permit connecting portions with recording elements or driving elements to exist at a high density, whereby the number of the connecting portions can be increased to enable higher densification. This also enables miniaturization of even a lengthy unit.

Also, the electrical connecting member can be made thinner, and also from this aspect, the unit can be made thinner.

Further, because the amount of the metal to be used for electrical connecting member is small, cost reduction becomes possible even if expensive gold may be used as the metal member.

Also, owing to adjustment of the pitch of the electroconductive members of the electrical connecting member, and arrangement of the connecting portions of the recording element and/or the driving element in a number more by at least one than the necessary number, connection becomes possible without performing registration or without requiring high precision in performing registration, if any, even in the case of a lengthy unit.

Particularly, in the case when the ink jet driving unit is a bubble jet system, registration can be done with difficulty because higher density wiring is demanded, but according to the present invention, registration can be done with extreme ease even in the case of such high density wiring.

Further, in the present invention, since the electrical connecting member is used, the recording element substrate and the driving element substrate can be connected freely detachably, whereby the driving element substrate can be separated easily, and hence can be also exchanged easily.

According to the present invention, since the base surfaces of the recording element substrate and the driving element substrate can be formed on the same plane, working during mechanical fixing can be made easier.

Also, according to the present invention, the recording element substrate and the driving element substrate can be connected freely detachably, whereby the driving element substrate can be separated easily, and hence can be exchanged easily.

According to the present invention, since the recording element substrate and the driving element substrate can be formed on the same base stand, preparation of the recording element driving unit can be made easier, and further working during mounting of the recording element driving unit onto the recording device can be made easier.

Also, according to the present invention, the recording element substrate and the driving element substrate can be connected freely detachably, whereby the driving element substrate can be separated easily, and hence can be exchanged easily.

In the present invention, by use of a plurality of small electrical connecting members juxtaposed in connecting recording elements or driving elements by use of the electrical connecting member as described above, the respective electrical connecting members can be small, and even when used for a lengthy unit, the precision of the pitch of the electroconductive members is not required to be so high.

In juxataposing the above plurality of small electrical connecting members, by taking sufficient intervals between the respective electrical connecting members, or by use of electrical connecting members having grooves and/or holes for the holding member, warping of the unit through thermal expansion of the recording element substrate, the electrical connecting member, the driving element substrate, etc. can be prevented.

Particularly, in the case where the ink jet driving unit is a bubble jet system, higher density wiring is demanded and therefore the pitch of the electroconductive members is required to have high precision and is also greatly influenced by thermal expansion, but in the present invention, there is no such problem even in the case of such high density wiring.

EXAMPLE 1

Figure 3A:
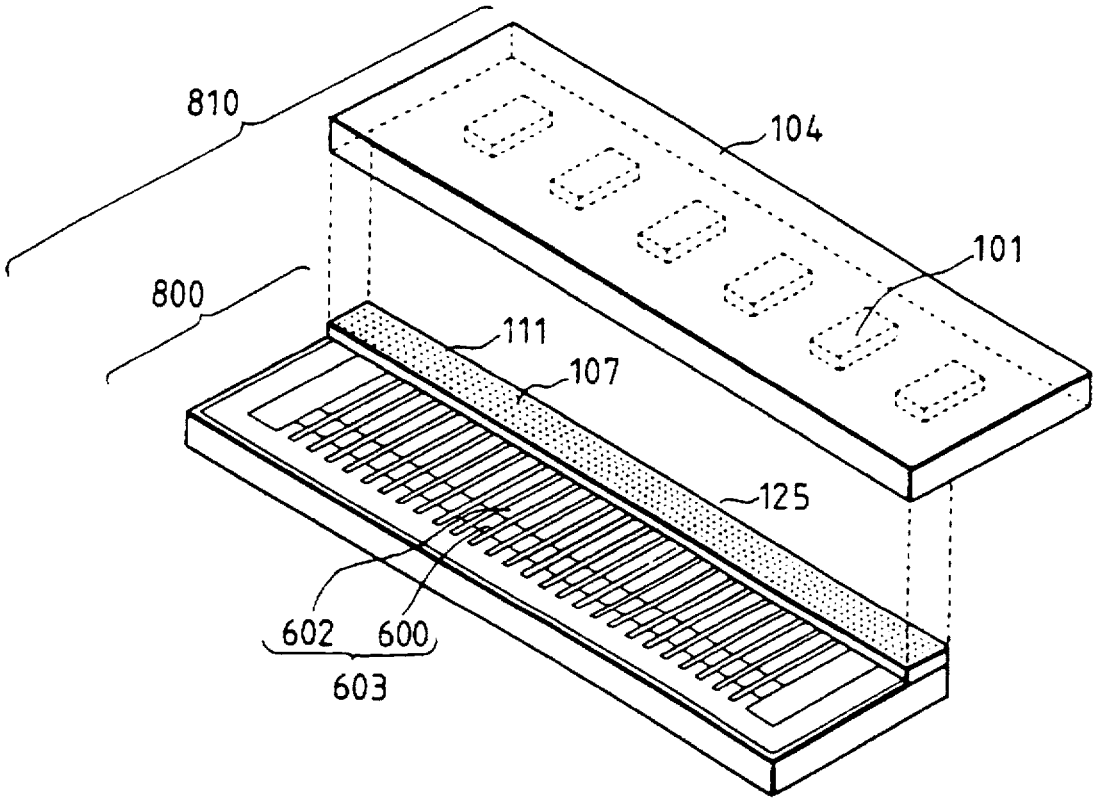
FIGS. 3A, 3B and 3C are respectively a schematic perspective view, a schematic perspective view and a schematic side view for illustration of the connected state mutually between the element substrates according to the present invention.
Figure 3B:
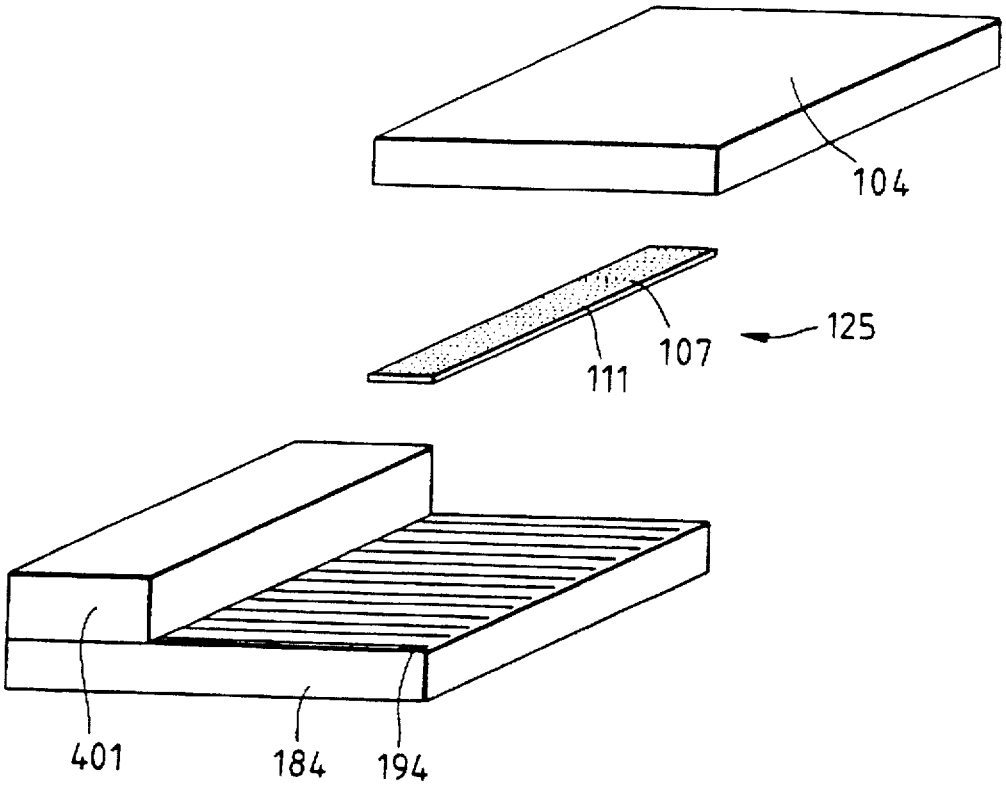

A first example of the present invention is described by referring to FIGS. 3A to 3B.

First, the recording element unit 800 is described by referring to FIG. 3A.

The recording element unit 800 of this Example has a holding member 111 formed by use of an electrical insulating material;

an electrical connecting member 125 having a plurality of electroconductive members 107 embedded in said holding member 111, with one end of said electroconductive member 107 being exposed on one surface of said holding member 111 and the other end of said electroconductive member 107 being exposed on the other surface of said holding member 111; and a recording element substrate having a plurality of recording elements (heat-generating elements) 603 arranged thereon, more by at least one than the necessary number to be actuated during recording;

one end of the electroconductive member 107 exposed on one surface of said electrical connecting member 125 being connected to said recording element 603.

In this Example, the heat-generating element 603 is formed of a heat-generating member 600 and electrodes 602 formed in a line in this Example.

Next, the recording element driving unit is to be described.

The recording element driving unit 810 of this Example has a holding member 111 formed by use of an electrical insulating material;

an electrical connecting member 125 having a plurality of electroconductive members 107 embedded in said holding member 111, with one end of said electroconductive member 107 being exposed on one surface of said holding member 111 and the other end of said electroconductive member 107 being exposed on the other surface of said holding member 111; and a recording element substrate 184 having recording elements 603 arranged thereon;

a driving element substrate 104 having driving elements having connecting portions arranged thereon, more by at least one than the necessary number to be utilized during recording;

one end of the electroconductive member 107 exposed on one surface of said electrical connecting member 125 being connected to said recording element 603;

and the other end of the electroconductive member 107 exposed on the other surface of said electrical connecting member 125 being connected to the connecting portion of said driving elements.

Next, the ink jet unit of this Example is described by referring to FIG. 3B.

The ink jet unit of this Example has a holding member 111 formed by use of an electrical insulating material;

an electrical connecting member 125 having a plurality of electroconductive members 107 embedded in said holding member 111, with one end of said electroconductive member 107 being exposed on one surface of said holding member 111 and the other end of said electroconductive member 107 being exposed on the other surface of said holding member 111; and a recording element substrate 184 having a plurality of recording elements 603 more by at least one than the necessary number arranged thereon;

said recording element substrate 184 having liquid pathways communicated to discharging openings for discharging ink formed by use of a member 401 thereon.

Figure 3C:
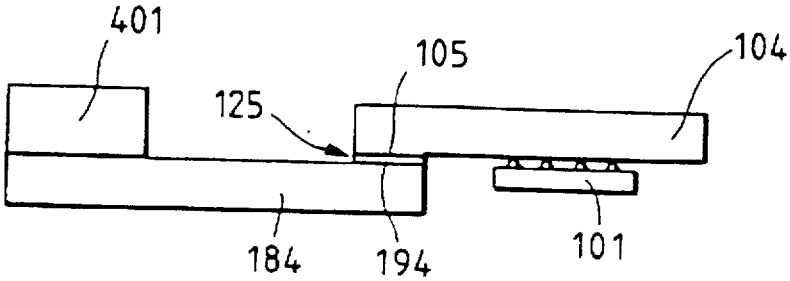

Next, the ink jet driving unit is described by referring to FIG. 3C.

The ink jet driving unit 29 of this Example has;

an electrical connecting member 125 having a holding member 111 formed by use of an electrical insulating material and a plurality of electroconductive members 107 embedded in said holding member 111, with one end of said electroconductive member 107 being exposed on one surface of said holding member 111 and the other end of said electroconductive member 107 being exposed on the other surface of said holding member 111;

a recording element substrate 184 having recording elements 603 arranged thereon; and a driving element substrate 104 having a driving element 101 having connecting portions more by at least one than the necessary number arranged thereon;

said recording element substrate 184 having liquid pathways communicated to discharging openings for discharging ink formed by use of a member 401 thereon;

one end of the electroconductive member 107 exposed on one surface of said electrical connecting member 125 being connected to said recording element 603;

and the other end of the electroconductive member 107 exposed on the other surface of said electrical connecting member 125 being connected to the connecting portion of said driving element 101.

Figure 19:
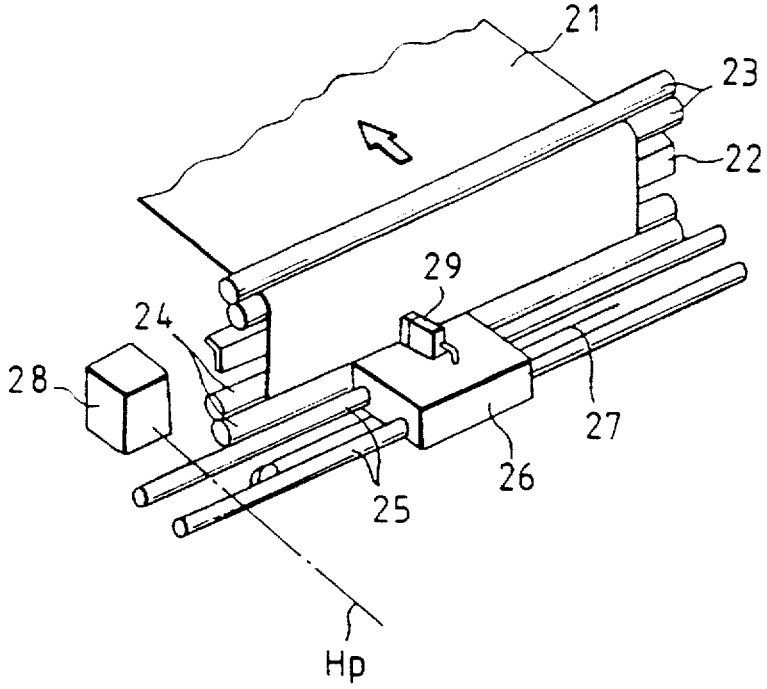
FIG. 19, FIG. 20 and FIG. 22 are respectively schematic perspective views showing the main parts of the ink jet device according to the present invention.

Further, the ink jet device of this Example is described by referring to FIG. 19.

Figure 20:
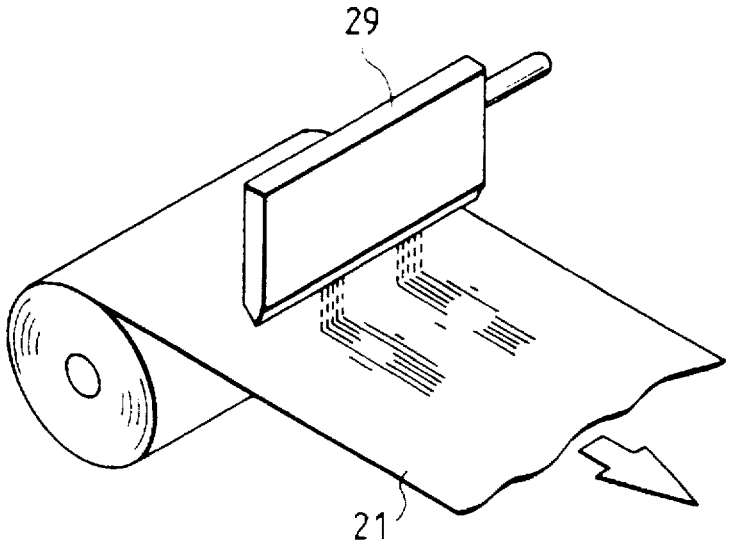

The ink jet device of this Example has the ink jet driving unit 29 as described above and a means 26 for mounting said ink jet driving unit 29. In FIG. 19, the serial scanning type is shown, but the full line type as shown in FIG. 20 is preferable as described above.

This Example is described in more detail below.

First, the electrical connecting member 125 is described by describing a preparation example of the electrical connecting member 125.

Figure 4:
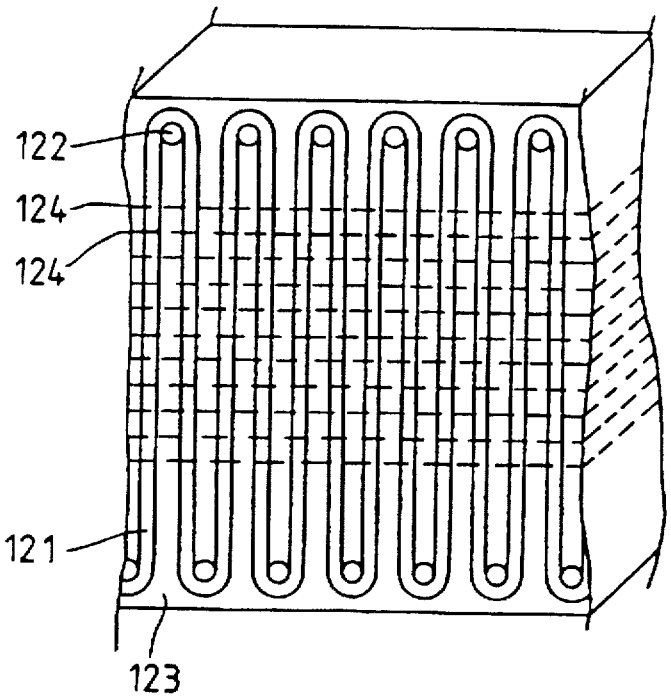
FIG. 4 is a schematic diagram for illustration of the preparation method of the electrical connecting member according to the present invention.

FIG. 4 shows a perspective example.

First, as shown in FIG. 4, a 20 μmϕ metal wire 121 comprising a metal such as gold, etc. or an alloy is wound up around a rod 122 with a pitch of 40 μm, and after winding, the above metal wire 121 is embedded in a resin 123 such as of polyimide, etc. After embedding, the above resin 123 is cured. The cured resin 123 becomes an insulating material. Then, the product is cut by slicing at the position of the dotted line 124 to prepare an electrical connecting member 125.

In the electrical connecting member 125 thus prepared, the metal wire 121 constitutes the metal member 107 and the resin 123 constitutes the holding member (insulating material) 111.

In the electrical connecting member 125, the metal wires 121 are mutually electrically insulated with the resin 123. Also, one end of the metal wire 121 is exposed on the driving element substrate 104 side, and the other end on the recording element substrate 184 side. The exposed portions become respectively the connecting portions 105, 194 with the driving element substrate 104, and the recording element substrate 184.

The electrical connecting member 125 in this Example has the portion of the metal member 107 exposed which is protruded from the surface of the holding member (resin insulating material) 111. Such electrical connecting member 125 can be prepared according to, for example, the following method.

That is, both surfaces of the electrical connecting member prepared according to the method as described above may be etched until the metal wire 121 is protruded by about 10 μm from the polyimide resin 123.

In this Example, the amount of the metal wire 121 protruded is made 10 μm, but any desired amount may be available.

The method for protruding the metal wire 121 is not limited to etching, but other chemical methods or mechanical methods may be employed.

Figure 5A:
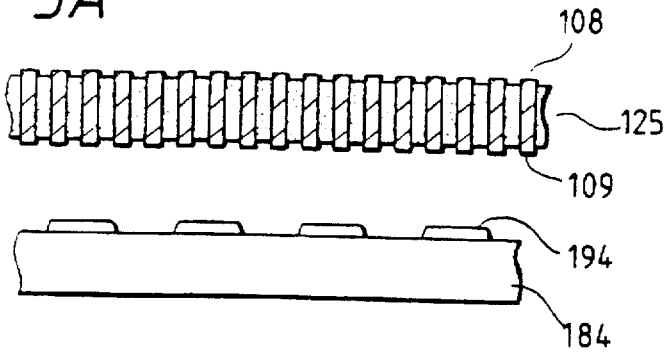
FIGS. 5A, 5B and 5C and FIGS. 6A, 6B and 6C are respectively schematic side sectional views for illustration of the connecting steps mutually between the element substrates through electrical connecting members according to the present invention.
Figure 5B:
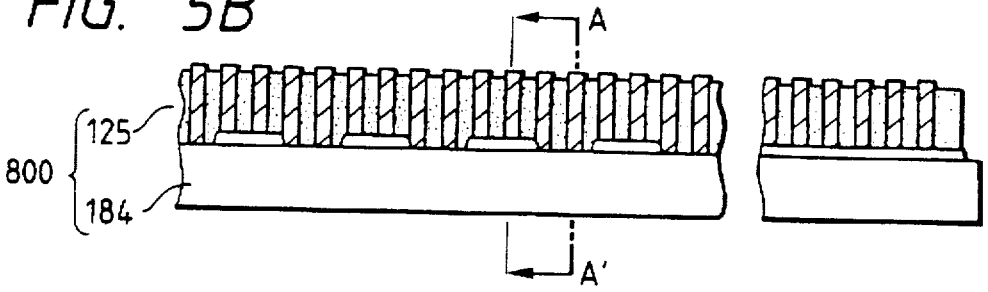
Figure 5C:
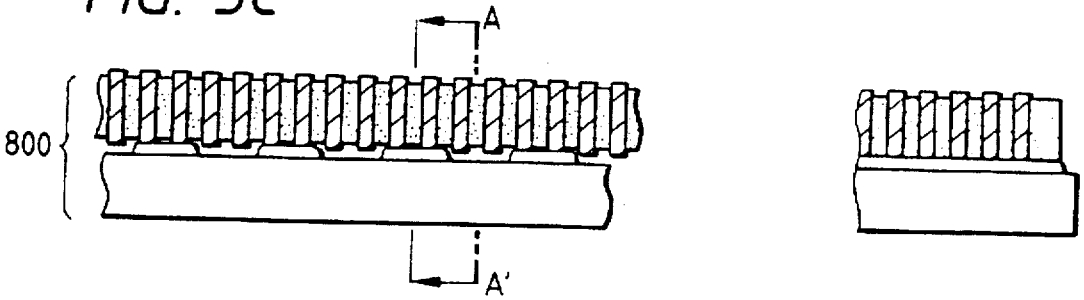

Next, as shown in FIG. 5A, a recording element substrate 184 is prepared.

Figure 7A:
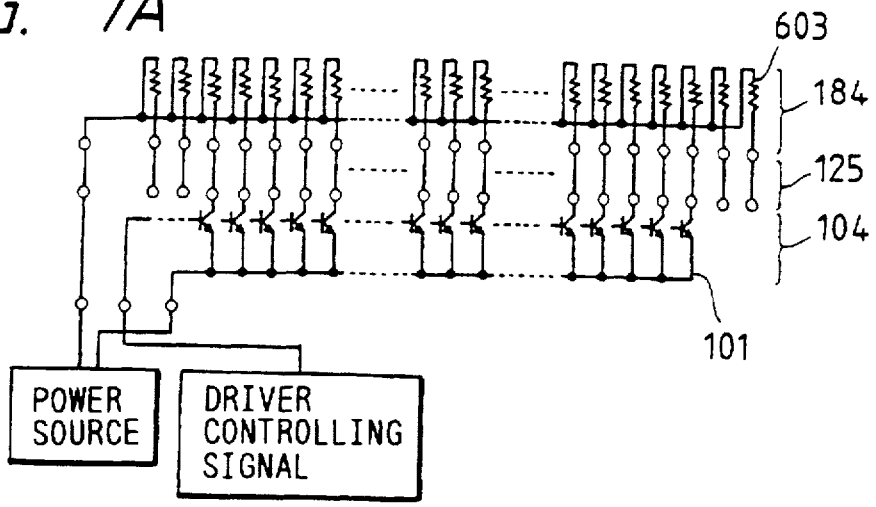
FIGS. 7A, 7B and 7C are equivalent circuit diagrams of the units according to the present invention.
Figure 7B:
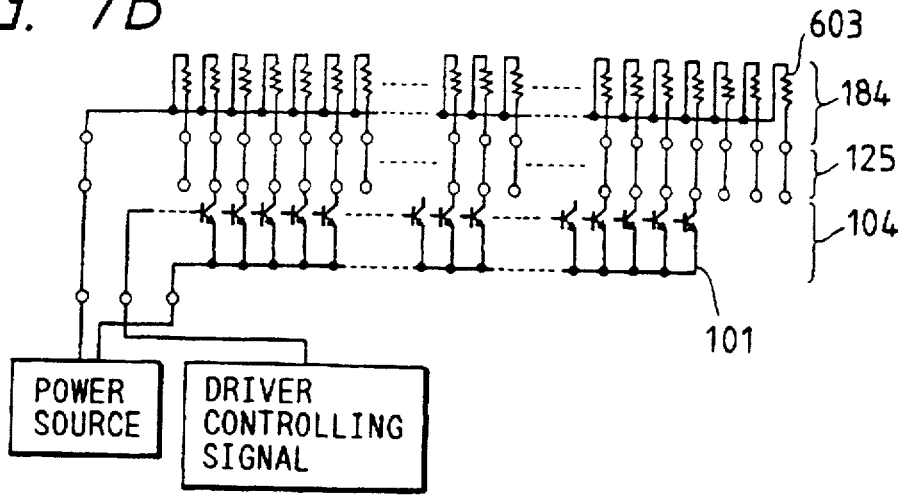

The recording element substrate 184 has more recording elements than the necessary number arranged thereon as shown in the equivalent circuit diagrams of FIGS. 7A and 7B. The connecting portions 194 comprise Au. The recording element substrate is connected to the electrical connecting member without particular registration.

Since more recording elements than the necessary number are arranged, necessary connections can be effected between Au of the connecting portions 194 of the recording element substrate 184 and Au of the connecting portions 109 of the electrical connecting member 125 as shown in FIGS. 7A and 7B without performing particular registration.

This connection was effected by metallization and/or alloy formation. Of course, connecting may be effected by use of an adhesive.

The recording element unit is prepared according to the the steps as described above.

Next, the recording element driving unit is to be described below.

Figure 6A:
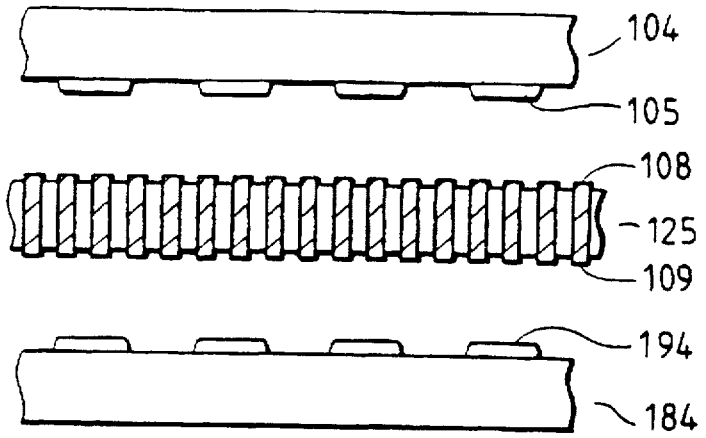

By connecting a driving element substrate 104 to the recording element unit prepared as described above, a recording element driving unit is prepared (FIG. 6).

Figure 6B:
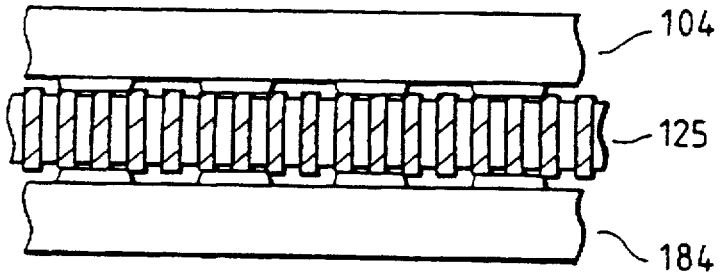
Figure 6C:
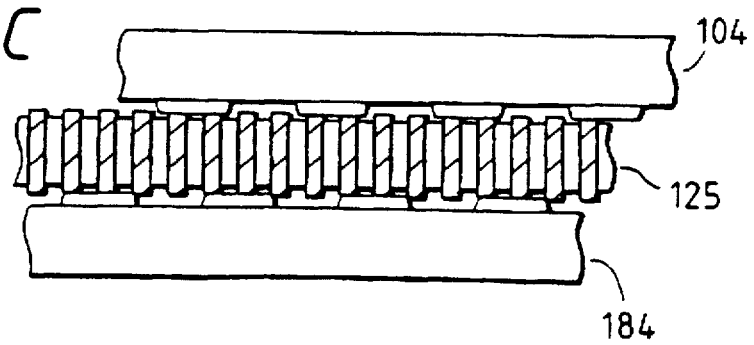
Figure 7C:
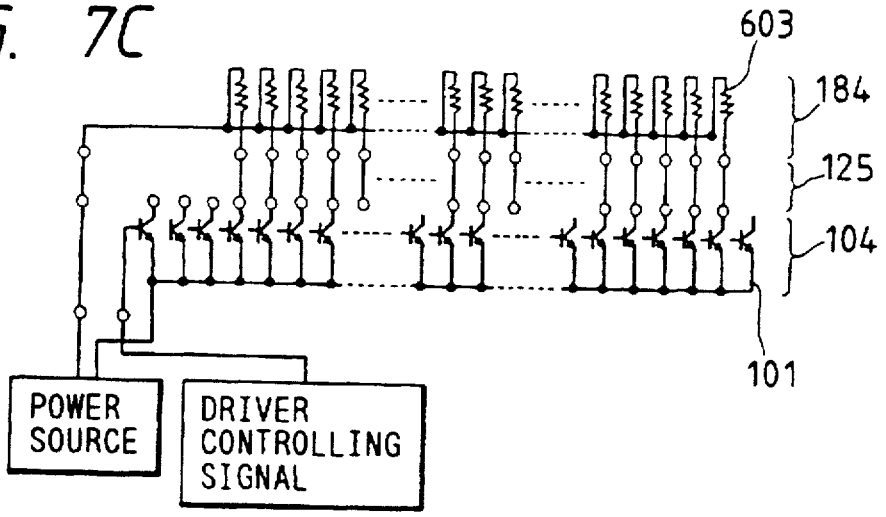

On the driving element substrate 104 are formed more driving elements than the necessary number as shown in FIG. 7C. Accordingly, as shown in FIGS. 6B and 6C, necessary connections can be obtained without performing strict registration.

The pitch of the connecting portions of the driving element substrate 104 in this Example is 63.5 μm.

This is, the pitch of the connecting portions in the present invention is not particularly limited in effecting necessary connections even without performing strict registration, but in the electrical connecting member 125 of this Example, the pitch mutually between the metal members 107 is made narrower, and thus by choosing the connecting dimension of the recording element substrate 104, or the driving element substrate 184 and the connecting dimension of the electrical connecting member at adequate values, connection is possible without registration.

Connection of the driving element substrate may be preferably according to the freely detachable connecting method.

In the case of connection by way of metallization and/or alloy formation, by making the melting point of the alloy layer at the connecting portion 105 lower than that of the alloy layer at the connecting portion 109, only the driving element substrate can be made detachable as desired by heating to a temperature between the both melting points. For example, for the connecting portion 108, a solder with an eutectic composition of Sn:Pb weight ratio of 61.9%:38.1% may be employed, and a solder with Sn:Pb weight ratio of 5%:95% for the connecting portion 109.

Next, the ink jet unit and the ink jet driving unit are to be described. These units are prepared by forming a liquid pathway communicated to a discharging orifice for discharging ink on the recording element substrates of the recording element unit and the recording element driving unit as described above as shown in FIGS. 3B and 3C.

EXAMPLE 2

Figure 8C:
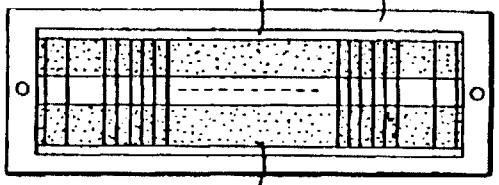
FIG. 8C is a schematic plan view showing the state where circuit substrate and electrical connecting member are provided on pressure-contact member.
Figure 8B:
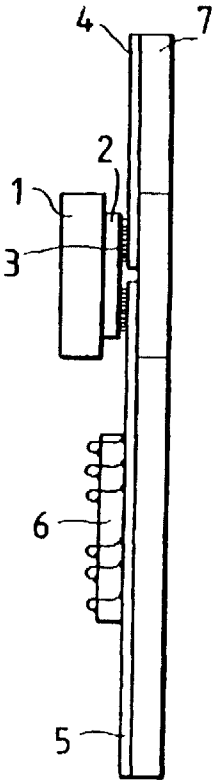
FIGS. 8A and 8B, FIGS. 9A and 9B, FIGS. 10A and 10B and FIGS. 11A and 11B are respectively schematic top views and schematic side views for illustration of the connection mutually between the element substrates according to the present invention.
Figure 8A:
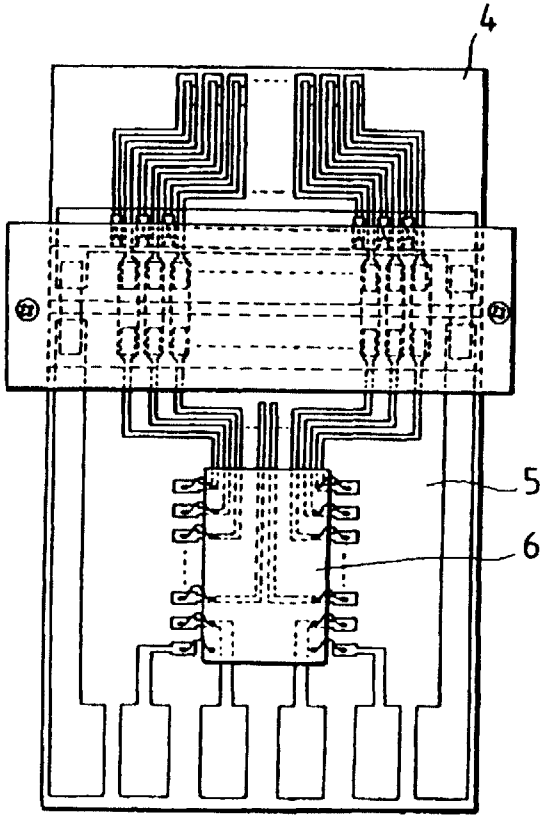

FIGS. 8A to 8C are diagrams for illustrating an example of the recording element driving unit according to the present invention. FIG. 8A is a view seen from above the standard surface (the surface on which elements, etc. are mounted of the recording element driving unit of this Example, and FIG. 8B a sectional view. FIG. 8C is a diagram for illustration of the state in which a circuit substrate 2 and an electrical connecting member 3 are arranged on a pressure contact member 1. In the drawing, 1 is a pressure contact member, 2 a circuit substrate, 3 an electrical connecting member, 4 a recording element substrate, 5 a driving element substrate, 6 a driving element and 7 a base member.

The pressure contact member 1 is fixed on the substrate 7 on the both ends in the lengthy direction by such method as screwing, etc. as shown in FIG. 8A, and through the pressure, the circuit substrate arranged between the pressure contact member 1 and the base member 7, the electrical connecting member and the recording element substrate, and the circuit substrate, the electrical connecting member and the driving element substrate are mutually pressure contacted with each other.

In FIG. 8C, the upper electrical connecting member 3 is electrically conducted to the lower electrical connecting member 3 through the circuit substrate 2, and therefore the recording element substrate 4 and the driving element substrate 5 are electrically conductive to each other (see FIG. 8B).

Thus, according to this Example, since a recording element driving unit can be formed on one base member and therefore preparation of the recording element driving unit can be made easier, and also mounting of the recording element driving unit onto a recording device can be made easier.

EXAMPLE 3

Figure 9B:
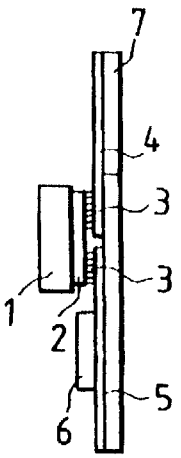
Figure 9A:
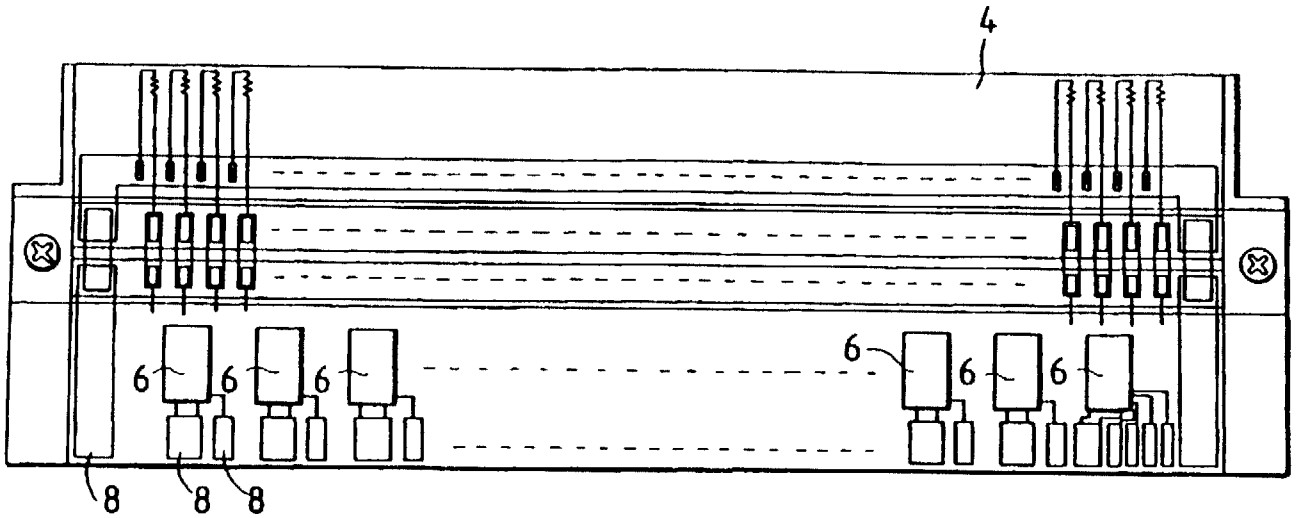

FIGS. 9A and 9B are diagrams for illustration of a second example of the recording element driving unit of the present invention. FIG. 9A is a view as seen from above the standard surface of the recording element driving unit of this Example, and FIG. 9B is a sectional view.

The difference of this Example from Example 2 is that the interval between the electrodes on the recording element substrate is smaller.

Thus, according to the present invention, the interval between the electrodes on the recording element substrate can be made smaller than connection by way of wire bonding.

In the recording element driving unit as shown in Example 2 and Example 3, by use of one having liquid pathways communicated to discharging openings for discharging ink formed on the recording element substrate, an ink jet recording unit can be obtained.

Also, by use of said ink jet driving unit, an ink jet recording device can be obtained.

EXAMPLE 4

Figure 10A:
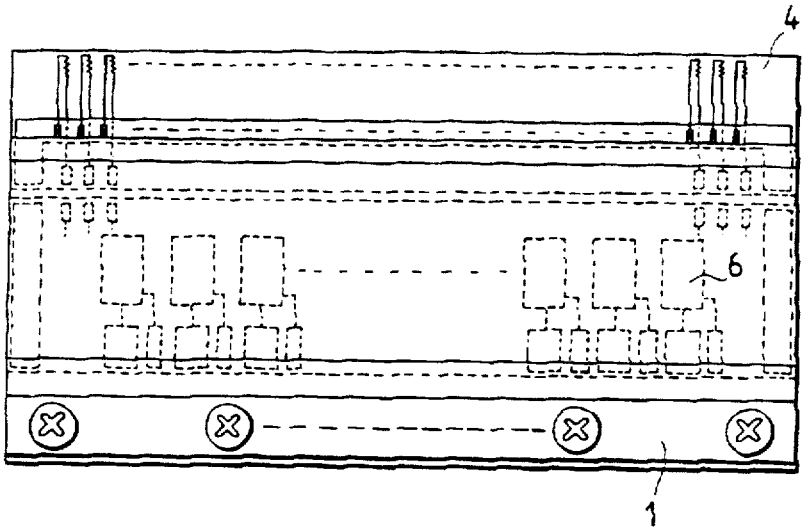
Figure 10B:
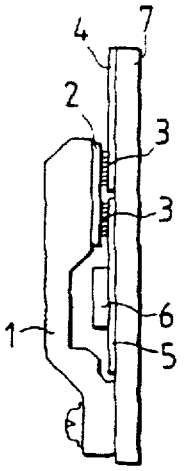

FIGS. 10A and 10B are diagrams for illustration of an example of the recording element driving unit according to the present invention. FIG. 10A is a view as seen from above the standard surface of the recording element driving unit of this Example, and FIG. 10B a sectional view.

The difference of this Example from Example 2 and Example 3 resides in making the shape of the pressure contact member 1 to that as shown in FIG. 10B and changing the position of fixing by screwing, etc. By forming such constitution, there is no fear of warping of the pressure contact member 1 even when the number of recording elements mounted on the recording element driving unit is many (that is when the length of the recording element driving unit is long).

In such recording element driving unit, by use of one having liquid pathways communicated to discharging openings for discharging ink formed on the recording element substrate, an ink jet recording unit can be obtained.

Also, by use of said ink jet driving unit, an ink jet recording device can be obtained.

EXAMPLE 5

Figure 11A:
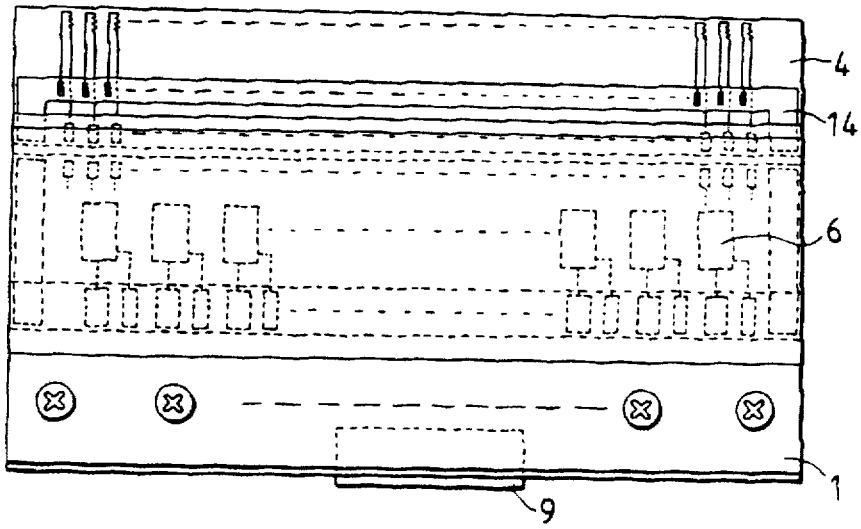
Figure 11B:
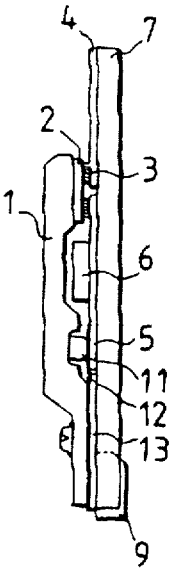

FIGS. 11A and 11B are diagrams for illustration of an example of the recording element driving unit according to the present invention. FIG. 11A is a view as seen from above the standard surface of the recording element driving unit of this Example, and FIG. 11B a sectional view. In the drawing, the parts labelled with the same symbols as in FIGS. 10A and 10B indicate the same parts as in FIG. 10. Numeral 9 is a connector, 11 a rubber for pressure contact, 12 a flexible cable and 13 a flexible cable reinforcing plate.

The difference of this Example from Example 3 resides in providing newly a connector for inputting image signals, etc. into the recording element driving unit and a means for connecting electrically the driving element substrate to the connector (flexible cable, etc.), and further providing an elastic member for pressure contacting the flexible cable, etc. with the driving element substrate (rubber, etc.).

In this Example, since electrical connection between the flexible cable and the driving element substrate can be also effected by pressure contact, preparation of the recording element driving unit can be made further easier.

In such a recording element driving unit, by use of one having liquid pathways communicated to discharging openings for discharging ink formed on the recording element substrate, an ink jet recording unit can be obtained.

Also, by use of said ink jet driving unit, an ink jet recording device can be obtained.

EXAMPLE 6

Figure 12A:
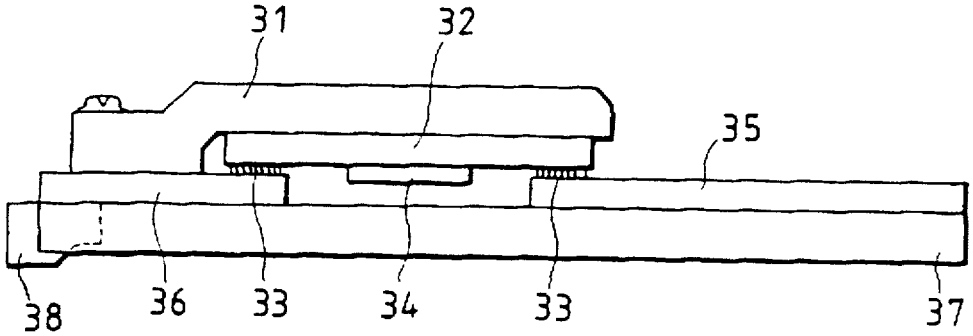
FIGS. 12A and 12B are respectively schematic side view and schematic top view for illustration of the connection mutually between the element substrates according to the present invention.
Figure 12B:
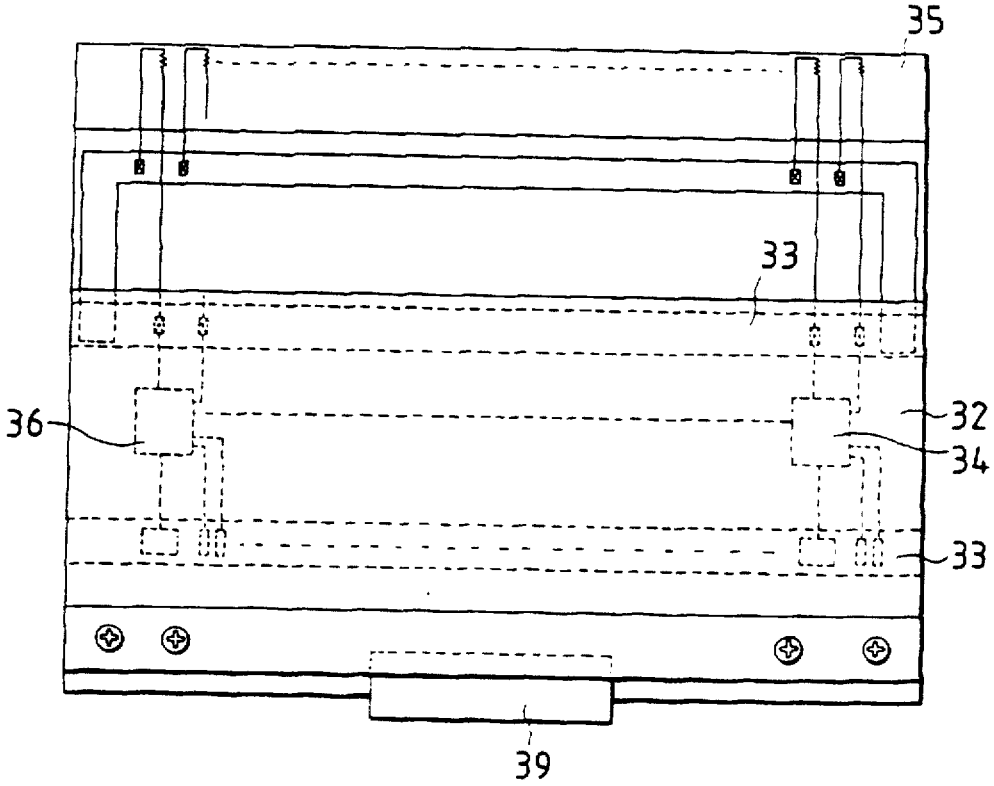

FIGS. 12A and 12B are diagrams for illustration of an example of the recording element driving unit according to the present invention. FIG. 12A is a sectional view of the recording element driving unit according to this Example, and FIG. 12B a view as seen from above the standard surface (the surface on which elements, etc. are mounted). In the drawing, 31 is a pressure contact member, 32 a driving element substrate, 33 an electrical connecting member, 34 a driving element, 35 a recording element substrate, 36 a circuit substrate, 37 a base member and 38 a connector. The recording element substrate and the circuit substrate used had the same thickness.

The pressure contact member 31, as shown in FIG. 12A, is fixed on the substrate 37 according to such method as screwing, etc., and through the pressure, the driving element substrate the electrical connecting member and the recording element substrate and the driving element substrate, the electrical connecting member and the circuit substrate, arranged between the pressure contact member 31 and the base member 37, are mutually pressure contacted with each other.

In FIG. 12A, the recording element substrate 35 and the driving element substrate 32 are electrically connected through the electrical connecting member 33 on the right side, and the driving element substrate 32 and the circuit substrate 36 electrically connected through the electrical connecting member 33 on the left side. Also, the circuit substrate 36 and the connector 38 are electrically connected, and image signals, etc. can be inputted externally.

Thus, according to this Example, mechanical fixing of the respective substrates of the recording element driving unit can be made easier, and also recording element driving units can be formed on one base member, and hence mounting of the recording element driving units onto the recording device can be also made easier.

In the recording element driving unit as shown in this Example, by use of one having a liquid pathway communicated to a discharging opening for discharging ink formed on the recording element substrate, an ink jet recording unit can be obtained.

Also, by use of said ink jet driving unit, an ink jet recording device can be obtained.

EXAMPLE 7

Figure 13:
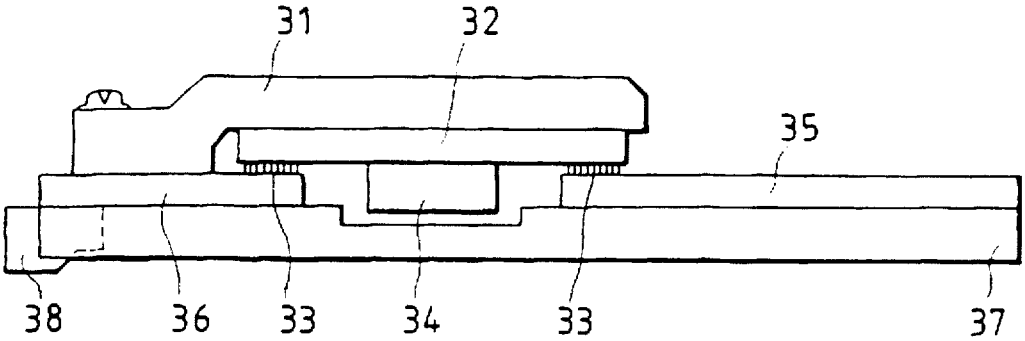
FIG. 13 is a schematic side view for illustration of the connection mutually between the element substrates according to the present invention.

FIG. 13 is a sectional view for illustration of an example of the recording element driving unit according to the present invention.

The difference of this Example from Example 6 resides in that the thickness of the base member is thick at the portion in contact with the recording element substrate and the circuit substrate and thin at the portion confronting the driving element.

Thus, according to this Example, by setting the difference between the thickness of the base member at the portions in contact with the recording element substrate and the circuit substrate and the thickness at the portion confronting the driving element as desired, the driving element can be mounted freely without being affected by the thickness of the driving element.

In the recording element driving unit as shown in this Example, by use of one having a liquid pathway communicated to a discharging opening for discharging ink formed on the recording element substrate, an ink jet recording unit can be obtained.

Also, by use of said ink jet driving unit, an ink jet recording device can be obtained.

EXAMPLE 8

Figure 14A:
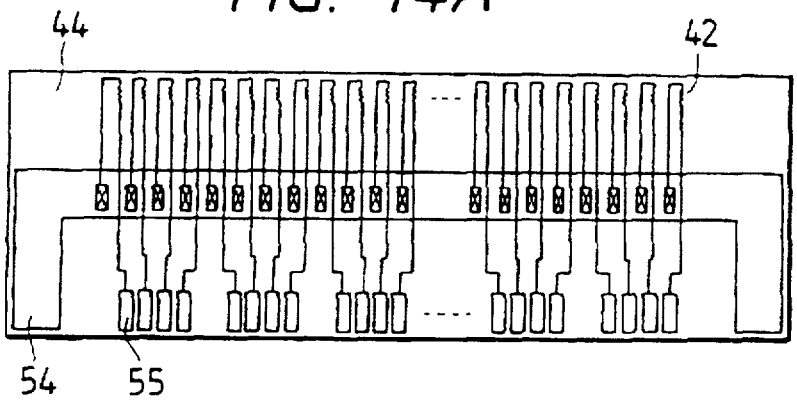
FIGS. 14A and 14B, FIG. 15 and FIG. 16 are respectively schematic top views for illustration of the connections between the element substrates and electrical connecting members according to the present invention.
Figure 14B:
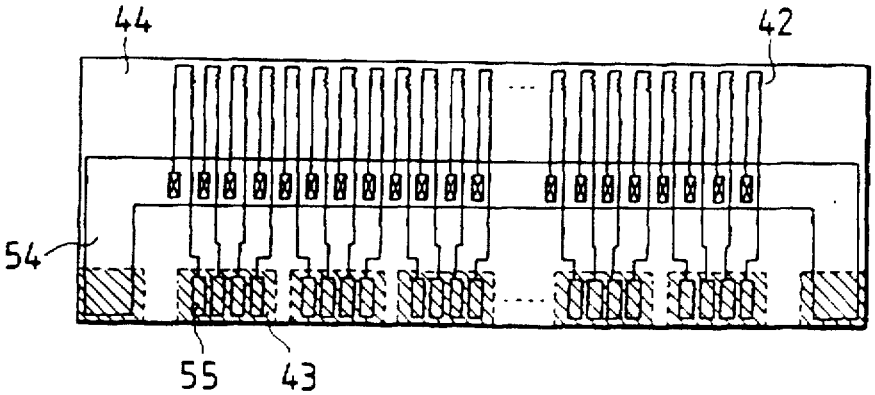

FIGS. 14A and 14B are diagrams for illustration of the recording element unit according to the eighth example of the present invention (the case of using a plurality of electrical connecting members). FIG. 14A shows the recording element substrate before provision of a plurality of electrical connecting members according to the present invention, and FIG. 14B the recording element substrate after provision of a plurality of electrical connecting members according to the present invention (namely the recording element unit). Numeral 44 is a recording element substrate, 42 a recording element, 54 and 55 are electrodes, and 43 is an electrical connecting member.

The electrodes 55 may be arranged at equal intervals, but more preferably arranged so as to form groups each of a certain number as shown in FIG. 14A. This is because the electrical connecting members 43 can be arranged more easily. The number of the electrodes 55 constituting each electrode group may be determined in view of the pitch of the electrodes 55, the balance between the pitch precision of electroconductive members 43 and the production cost.

On such a recording element substrate, electroconductive members 43 are arranged in FIG. 14B to form the recording element unit according to this Example.

In this case, the respective electrical connecting members 43 may be mutually contacted with each other, or not. In the present invention, there is the effect that the influence from the error of pitch of the electroconductive members is negligible because each electrical connecting member is small, but by arranging the electrical connecting member 43 so that they may not contact each other, there can be also obtained the effect that warping of the unit through thermal expansion of the recording element substrate 44 or electroconductive members 43 can be further prevented.

The interval of the electrical connecting members 43 may be determined in view of the difference in thermal expansion coefficient, etc. between the recording element substrate 44 and the electrical connecting members 43. When the thermal expansion of the recording element substrate 44 is constantly greater than the thermal expansion of the electrical connecting members 43, the above latter effect can be obtained as a matter of course even if the respective electrical connecting members 43 may be mutually contacted with each other.

When the recording element driving unit of the present invention is formed by bonding a driving element substrate to such a recording element unit of this Example, the material of the driving element substrate to be used may be preferably of the same material as the recording element substrate, or one with little difference in thermal expansion coefficient. For, if a material with great difference in thermal expansion coefficient is used, there is no influence on the above former effect, but the above latter effect may be lost.

As shown in FIG. 14A, when electrodes 55 are arranged so as to form groups, one may fear that the intervals required to be provided between the respective electrode groups may be an obstacle to high density arrangement of electrodes, but there is no such anxiety at all. For, in this Example, since the influence of pitch error of the electroconductive members arranged on the electrical connecting members can be made very small, said pitch and the pitch of the electrodes 44 can be made further smaller than in the case of using electrical connecting members of the prior art, whereby sufficient room for providing the intervals between the respective electrode groups can remain.

EXAMPLE 9

Figure 15:
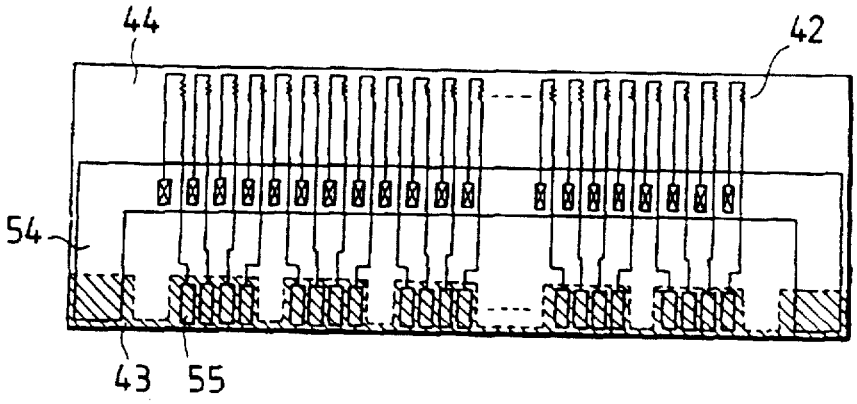
Figure 16:
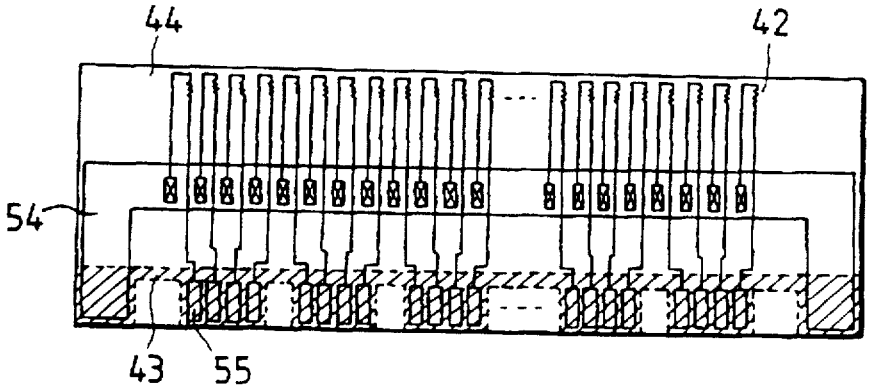

FIG. 15 and FIG. 16 are diagrams for illustration of the recording element unit according to the ninth example of the present invention. That is, this Example has grooves provided in electrical connecting members. The difference between FIG. 15 and FIG. 16 is that the positions where grooves are provided are different.

Also in this Example, there can be obtained the effect that warping of the unit through thermal expansion can be prevented. For, the surface area is by far larger than that of the electrical connecting member of the prior art, and therefore the heat dissipating effect is larger.

The number of electrodes constituting the respective electrode groups of the electrical connecting member of this Example, the intervals between the electrode groups, the number of grooves, the size of the groove do not relate to the essence of the present invention, but may be determined freely depending on the practice conditions as a matter of course.

The holding member according to this Example may be one having electrical connecting members as shown in the above Example 8 secured on a lengthy plate, or alternatively formed initially integrally, or may be formed according to other methods.

Further, in both FIG. 15 and FIG. 16, grooves are formed in the direction vertical to the recording element substrate, but the grooves may be also horizontal to the recording element substrate, and holes may be also formed in place of grooves, and it is also evident that grooves and holes may be used in combination.

EXAMPLE 10

In the above Example 8 and Example 9, the recording element unit according to the present invention has been described. Here, the recording element driving unit, the ink jet unit, the ink jet driving unit and the ink jet device according to the present invention are to be described.

Figure 17:
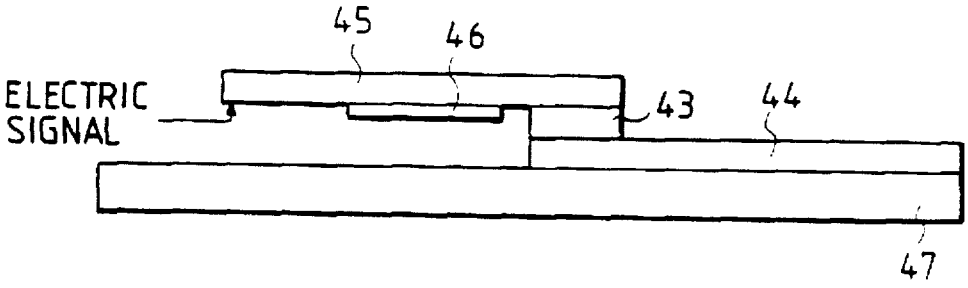
FIG. 17 and FIG. 18 are respectively sectional side views for illustration of the connection mutually between the element substrates according to the present invention.

The recording element driving unit according to the present invention is formed by connecting a driving element substrate to the recording element unit prepared as described above and takes, for example, a constitution as shown in FIG. 17. In the drawing, 43 is the recording element, 44 the recording element substrate, 45 the driving element substrate and 46 the driving element.

Figure 18:
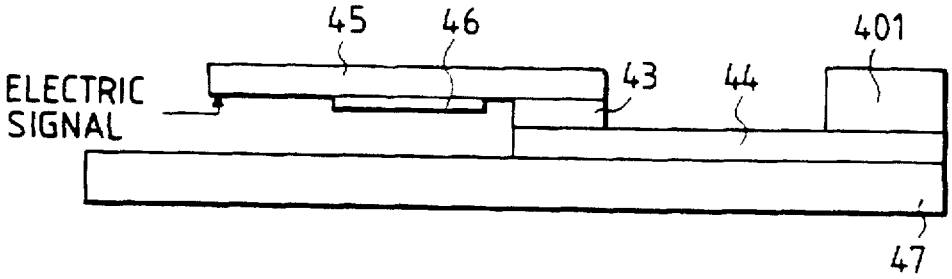

Next, the ink jet unit and the ink jet driving unit according the present invention are to be described. The ink jet unit according to the present invention has liquid pathways communicated to discharging openings for discharging ink formed on the recording element unit prepared as described above, and the ink jet driving unit according to the present invention has a driving element substrate connected to this ink jet unit. FIG. 18 shows an example of the ink jet unit and the ink jet driving unit according to the present invention. In the drawing, 48 is the ink jet unit, 45 the driving element substrate and 46 the driving element.

Finally, the ink jet recording device according to the present invention is to be described. FIG. 19 illustrates an example of the main part of the ink jet recording device according to the present invention. In the drawing, the recording sheet 21 is conveyed by paper feeding rollers to sheet delivery rollers 23, 24 set up and down with a predetermined interval, and subjected to sheet delivery in the direction of the arrowhead A along the platen 22.

In front of the above recording sheet 21 is provided a carriage 26 which moves along the guide shaft 25. On the carriage 26 is mounted the ink jet driving unit 29 as described above.

The above carriage 26 is driven in a reciprocal fashion by the carriage driving motor (not shown) through the belt transmission mechanism 27.

In the Example, simultaneously with driving of the above carriage 26 along the width direction of the recording sheet 21, ink is discharged as a droplet through the discharging opening of the above ink jet driving unit toward the recording sheet 21 to effect recording thereon. The liquid pathway of the ink jet driving unit has at, for example, its tip end a discharging opening formed as directed to the recording sheet 21. Corresponding to a signal from the driving element, ink is discharged from the discharging opening to permit an ink droplet to fly. The symbol 28 shows schematically a restoration means including the cap for preventing defective discharging of ink from the discharging opening.

FIG. 20 shows another example of the ink jet recording device of the present invention. The difference of this Example from the above ink jet recording device resides in that the ink jet driving unit 29 of the Example is provided with the recording elements corresponding to the recording width of the recording paper 21. Accordingly, the carriage is not required to be driven in a reciprocal fashion, whereby the mechanism can be simple and high speed recording is possible. In this Example, since a very long unit is employed, the effect of the present invention is enormous.

Figure 21:
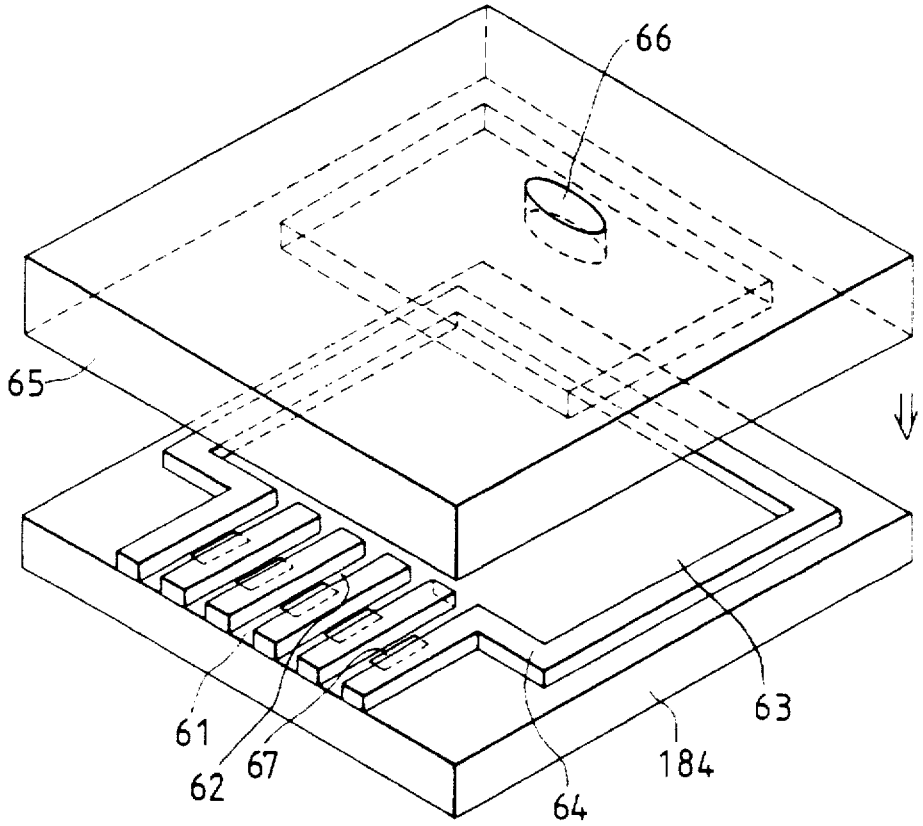
FIG. 21 is a schematic exploded perspective view showing the main part of the ink jet head according to the present invention.

FIG. 21 is a schematic exploded perspective view showing an example of the ink jet unit and the ink jet driving unit according to the present invention.

In FIG. 21, the symbol 61 is a discharging opening, 62 an ink pathway communicated to the discharging opening 61, and 63 an ink chamber communicated to the ink channel 62. The liquid pathway in this Example has an ink pathway 62 and an ink chamber 63. In this Example, the ink pathway 62 and the ink chamber 63 are formed by bonding the recording element substrate 184 in FIG. 21 (for better understanding of explanation, the length is drawn shorter), the wall forming member 64 and the covering member 65 mutually together. Further in this Example, heat-generating portions 67 of a heat-generating elements as the recording elements are provided corresponding to each ink pathway 62, and these heat-generating portions 67 have electrodes (not shown in FIG. 21) arranged thereon. The symbol 66 in FIG. 21 is an ink feeding inlet into the ink chamber 63.

Figure 22:
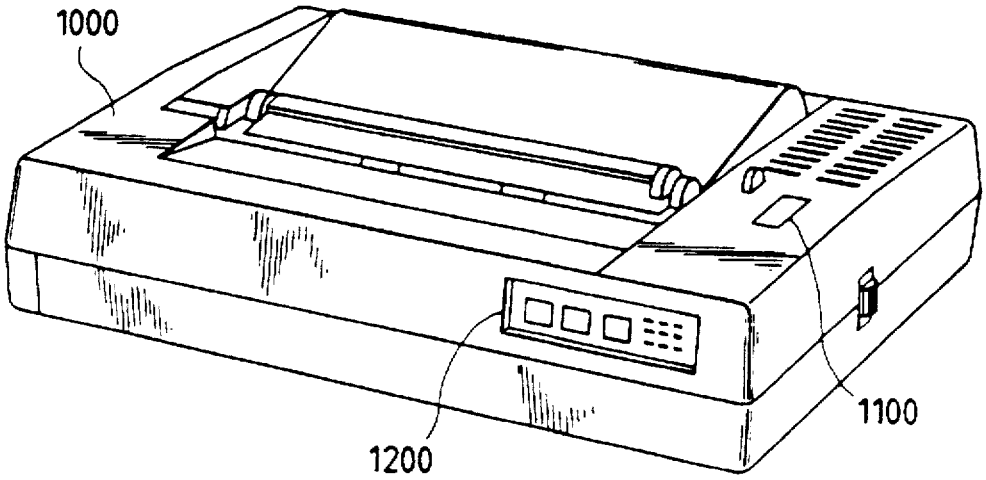

FIG. 22 is a schematic appearance perspective view showing an example of the ink jet device according to the present invention. In FIG. 22, the symbol 1000 is the main device, 1100 the power switch and 1200 the panel for operation.

The present invention will bring about excellent effects particularly in the recording head and the recording device of the bubble jet system among ink jet recording systems.

As for its representative constitution and principle, it is preferable to practice the system by use of the basic principle as disclosed in, for example, U.S. Pat. Nos. 4,723,129 and 4,740,796. This system is applicable to any of the so called on-demand type and the continuous type, but particularly in the case of the on-demand type, heat energy is generated in the electrothermal transducer by applying at least one driving signal which gives abrupt temperature elevation exceeding nucleate boiling corresponding to the recording information to the electrothermal transducer arranged corresponding to the sheet or liquid pathway wherein a liquid (ink) is held, thereby effecting film boiling on the heat-acting surface of the recording head and consequently forming effectively bubbles within the liquid (ink) corresponding one by one to the driving signals. By growth and shrinkage of such a bubble, the liquid (ink) is discharged through the opening for discharging to form at least one droplet. If the driving signal is made a pulse shape, growth and shrinkage of bubbles can be effected instantly and adequately and therefore particularly excellent discharging of liquid (ink) can be accomplished, more preferably. As the pulse-shaped driving signal, those as described in U.S. Pat. Nos. 4,463,359 and 4,345,262 are suitable. Further excellent recording can be done by employment of the conditions as described in U.S. Pat. No. 4,313,124 of the invention concerning temperature elevation rate of the heat-acting surface.

As the constitution of the recording head, in addition to the combined constitution of discharging opening, liquid pathway, electrothermal transducer (linear liquid pathway or right angle liquid pathway) as disclosed in the respective specifications as described above, the constitutions by use of U.S. Pat. Nos. 4,558,333 and 4,459,600 disclosing the constitution in which the heat-acting portion is arranged in a flexed region are also included in the present invention. In addition, the present invention is also effect as the constitution based on Japanese Laid-open Patent Application No. 59-123670 which discloses the constitution having a common slit as the discharging portion of the electrothermal transducer to a plurality of electrothermal transducer or Japanese Laid-open Patent Application No. 59-138461 which discloses the constitution having the opening absorbing the pressure wave of heat energy corresponding to the discharging portion.

Further, as the recording head of the full line type having a length corresponding to the maximum recording medium width which can be recorded by the recording device, either a constitution which fills its length by a combination of a plurality of recording heads as disclosed above or a constitution as one recording head integrally formed may be available, but the present invention can exhibit further effectively the effects as described above.

In addition, the present invention is also effective in the case when a recording head of the freely exchangeable chip type which enables electrical connection to the main device or feeding of ink from the main device when mounted on the main driver, or a recording head of the cartridge type provided integrally onto the recording head itself is used.

Also, addition of a restoration means, a preliminary auxiliary means, etc. for the recording head provided as the constitution of the recording device of the present invention is preferable because the effect of the present invention can be further stabilized. Specific examples of these means may include capping means, cleaning means, pressurization or aspiration means, electricity-heat convertors, preliminary heating means separate from these or preliminary heating means according to a combination of these, and it is also effective for performing stable recording to perform preliminary discharging mode which performs another discharging separate from recording.

Further, as the recording mode of the recording device, not only the recording only of black, etc. as the main color, but also the recording head may be integrally constituted or a plurality of recording heads may be combined, but the present invention is also very effective for a device equipped with at least one of complex color with different colors or full color by color mixing.

The present invention has been constituted as described above and therefore can give a number of effects as set forth below.

In the present invention, since the electrical connecting member as described above is used and connected to the recording element or the driving element, it becomes possible to permit the connecting portions of the recording element or the driving element at high density, whereby the number of connecting portions can be increased to effect higher densification. This also enables miniaturization even of a lengthy unit.

Also, electrical connecting members can be made thinner, and also from this aspect, the unit can be made thinner.

Further, because the amount of the metal member used for the electrical connecting member is small, cost reduction becomes possible even if expensive gold may be used as the metal member.

By adjustment of the pitch of the electroconductive members of the electrical connecting member and arrangement of connecting portions of the recording element and/or the driving element in a number more by at least one than the necessary number, connection becomes possible without performing registration or without requiring registration of high precision even if registration may be performed.

Particularly, in the case when the ink jet unit is the bubble jet system, registration can be done with difficulty because high density wiring is required, but according to the present invention, registration can be done with very ease even in the case of such high density wiring.

Also, in the present invention, since an electrical connecting member is used, the recording element substrate and the driving element substrate can be connected freely detachably, and the driving element substrate can be easily separated and hence can be exchanged easily.

Further, in the ink jet head of the bubble jet system, the driving element (heat-generating element) may be frequently damaged sooner than other elements, but the present invention also has the advantage that the unit as a whole can be exchanged, thus being capable of copying with such case.

In the ink jet head of the bubble jet system, the tolerance width in voltage drop is relatively narrower, and the degree of freedom of electrical wiring is not seldom limited. The present invention can be very effective in accomplishing the technical requirement to provide discharging openings at high density and in a large number in such ink jet head of the bubble jet system.

Also, according to the present invention, since recording element driving unit can be formed on one base member, preparation of the recording element driving unit can be made easier, and also mounting of the recording element driving unit onto the recording device can be made easier.

Further, according to the present invention, since electrical connection between the flexible cable and the driving element substrate can be effected by pressure contact, preparation of the recording element driving unit can be made further easier.

Also, according to the present invention, by setting the difference between the thickness of the base member at the portions in contact with the recording element substrate and the circuit substrate and that at the portion confronting the driving element as desired, a driving element even with great thickness can be freely mounted.

Further, according to the present invention, in connecting the recording element or the driving element by use of an electrical connecting member, by use of a plurality of small electrical connecting members juxtaposed, each electrical connecting member can be small and the precision of the pitch of electroconductive members is not required to be so high even when used for a lengthy unit.

Also, according to the present invention, in juxtaposing the above plurality of small electrical connecting members, by taking sufficient intervals between the respective electrical connecting members, or by use of electrical connecting members having grooves and/or holes in the holding member, the unit can be prevented from warping through thermal expansion of the recording element substrate, the electrical connecting member, the driving element substrate, etc.

We claim:

1. A recording element driving unit comprising:

an electrical connecting member having a support member of an electrically insulating material and a plurality of electroconductive members arranged on said support member, each said electroconductive member having one end exposed on one surface of said support member and another end exposed on another surface of said support member;

a recording element substrate having thereon a plurality of recording elements connected to one exposed end of at least one said electroconductive member; and a driving element substrate having thereon a plurality of driving elements, each said driving element having connecting portions and said plurality of driving elements being larger in number than a number of driving elements electrically connected to said plurality of recording elements and fewer in number than said plurality of electroconductive members, said driving element connecting portions being disposed at a pitch larger than a pitch at which said plurality of electroconductive members are arranged, wherein each said driving element connecting portion is connected to the other exposed end of at least one said electroconductive member.

2. A recording element driving unit according to claim 1 wherein said recording element substrate has a liquid pathway communicated to a discharging opening for discharging ink formed thereon and said recording element performs recording by discharging ink through said discharging opening.

3. A recording element driving unit according to claim 2, further comprising a film which covers the other surface of said support member.

4. A recording element driving unit according to claim 3, wherein said film comprises an organic material.

5. In an ink jet apparatus, a recording element driving unit comprising:

an electrical connecting member having a support member of an electrically insulating material and a plurality of electroconductive members arranged on said support member, each said electroconductive member having one end exposed on one surface of said support member and another end exposed on another surface of said support member;

a recording element substrate having thereon a plurality of liquid pathways each communicating with a discharging opening for discharging ink and a plurality of recording elements for performing recording by discharging ink through said discharging opening, each said recording element being electrically connected to one exposed end of at least one said electroconductive member;

a driving element substrate having thereon a plurality of driving elements, each said driving element having connecting portions and said plurality of driving elements being larger in number than a number of driving elements electrically connected to said plurality of recording elements and fewer in number than said plurality of electroconductive members, said driving element connecting portions being disposed at a pitch larger than a pitch at which said plurality of electroconductive members are arranged, wherein each said driving element connecting portion is connected to the other exposed end of at least one said electroconductive member; and means for mounting said recording element driving unit.

6. A recording element driving unit comprising:

a plurality of electrical connecting members each having a support member of an electrically insulating material and a plurality of electroconductive members arranged on said support member, each said electroconductive member having one end exposed on one surface of said support member and another end exposed on another surface of said support member;

a recording element substrate having thereon a plurality of recording elements fewer in number than said plurality of electroconductive members, wherein each said recording element is electrically connected to an exposed end of at least one said electroconductive member;

a driving element substrate having thereon a plurality of driving elements, each said driving element having connecting portions and said plurality of driving elements being larger in number than a number of driving elements electrically connected to said plurality of recording elements and fewer in number than said plurality of electroconductive members, said driving element connecting portions being disposed at a pitch larger than a pitch at which said plurality of electroconductive members are arranged, wherein each said driving element connecting portion is connected to the other exposed end of at least one said electroconductive member;

a base member for arranging said recording element substrate and said driving element substrate;

a circuit substrate to which said recording element substrate is connected through a first one of said electrical connecting members and to which said driving element substrate is connected through a second one of said electrical connecting members on a surface of said circuit substrate where a wiring pattern is formed; and a pressure contact member for pressure contacting said circuit substrate with said recording element substrate, and said circuit substrate with said driving element substrate, respectively, through said electrical connecting members.

7. A recording element driving unit according to claim 6, further comprising an electrical signal transmitting means for transmitting a driving signal to the driving element substrate.

8. A recording element driving unit according to claim 6, further comprising a connector for inputting of a driving signal.

9. A recording element driving unit according to claim 6, wherein the recording element substrate and the driving element substrate are arranged on the same plane of the base member.

10. A recording element driving unit according to claim 6, wherein the pressure contact member is fixed on the base member at both ends in the longitudinal direction of said pressure contact member.

11. A recording element driving unit according to claim 6, wherein the pressure contact member is fixed on the base member at one end in the longer side of said pressure contact member.

12. A recording element driving unit according to claim 6 wherein said recording element substrate has a liquid pathway communicated to a discharging opening for discharging ink formed thereon.

13. A recording element driving unit according to claim 6, wherein the number of recording elements on the recording element substrate is at least one more than the necessary number.

14. In an ink jet recording apparatus, a recording element driving unit comprising:

a plurality of electrical connecting members each having a holding member of an electrically insulating material and a plurality of electroconductive members arranged on said holding member, each said electroconductive member having one end exposed on one surface of said holding member and another end exposed on another surface of said holding member;

a recording element substrate having thereon a liquid pathway communicating with a discharging opening for discharging ink and a plurality of recording elements fewer in number than said plurality of electroconductive members, wherein each said recording element is electrically connected to an exposed end of at least one said electroconductive member;

a driving element substrate having thereon a plurality of driving elements, each said driving element having connecting portions and said plurality of driving elements being larger in number than a number of driving elements electrically connected to said plurality of recording elements and fewer in number than said plurality of electroconductive members, said driving element connecting portions being disposed at a pitch larger than a pitch at which said plurality of electroconductive members are arranged, wherein each said driving element connecting portion is connected to the other exposed end of at least one said electroconductive member;

a base member for arranging said recording element substrate and said driving element substrate;

a circuit substrate to which said recording element substrate is connected through a first one of said electrical connecting members and to which said driving element substrate is connected through a second one of said electrical connecting members on a surface of said circuit substrate where a wiring pattern is formed;

a pressure contact member for pressure contacting said circuit substrate with said recording element substrate, and said circuit substrate with said driving element substrate, respectively, through said electrical connecting members; and means for mounting said recording element driving unit.

15. A recording element driving unit comprising:

a plurality of electrical connecting members each having a support member of an electrically insulating material and a plurality of electroconductive members arranged on said support member, each said electroconductive member having one end exposed on one surface of said support member and another end exposed on another surface of said support member;

a recording element substrate having thereon a plurality of recording elements fewer in number than said plurality of electroconductive members, wherein each said recording element is electrically connected to an exposed end of at least one said electroconductive member;

a driving element substrate having thereon a plurality of driving elements, each said driving element having connecting portions and said plurality of driving elements being larger in number than a number of driving elements electrically connected to said plurality of recording elements and fewer in number than said plurality of electroconductive members, said driving element connecting portions being disposed at a pitch larger than a pitch at which said plurality of electroconductive members are arranged, wherein each said driving element connecting portion is connected to the other exposed end of at least one said electroconductive member;

a circuit substrate for transmitting a driving signal to said driving element substrate;

a base member for arranging said recording element substrate and said driving element substrate; and a pressure contact member for pressure contacting said recording element substrate through a first of said plurality of electrical connecting members with said driving element substrate and for pressure contacting said circuit substrate through a second of said plurality of electrical connecting members with said driving element substrate.

16. A recording element driving unit according to claim 15, wherein the portion of the base member where the circuit substrate is arranged and the portion of the base member where the recording element is arranged have the same thickness, and the thickness of the portion of the base member confronting said driving element arranged on the driving element substrate is thinner than the thickness of the portion where said circuit substrate is arranged and the portion where the recording element is arranged.

17. A recording element driving unit according to claim 15 or 16, further comprising a connector for inputting of a driving signal.

18. A recording element driving unit according to claim 15 or 16, wherein the recording element substrate and the circuit substrate are arranged on the same plane of the base member.

19. A recording element driving unit according to claim 15 or 16, wherein the pressure contact member is fixed on the base member.

20. A recording element driving unit according to claim 15 wherein said recording element substrate has a liquid pathway communicated to a discharging opening for discharging ink.

21. A recording element driving unit according to claim 15 or 16, wherein the number of recording elements on the recording element substrate is at least one more than the necessary number.

22. In an ink jet recording apparatus, an ink jet driving unit comprising:

a plurality of electrical connecting members each having a support member of an electrically insulating material and a plurality of electroconductive members arranged on said support member, each said electroconductive member having one end exposed on one surface of said support member and another end exposed on another surface of said support member;

a recording element substrate having thereon a liquid pathway communicating with a discharge opening for discharging ink and a plurality of recording elements fewer in number than said plurality of electroconductive members, wherein each said recording element is electrically connected to an exposed end of at least one said electroconductive member;

a driving element substrate having thereon a plurality of driving elements, each said driving element having connecting portions and said plurality of driving elements being larger in number than a number of driving elements electrically connected to said plurality of recording elements and fewer in number than said plurality of electroconductive members, said driving element connecting portions being disposed at a pitch larger than a pitch at which said plurality of electroconductive members are arranged, wherein each said driving element connecting portion is connected to the other exposed end of at least one said electroconductive member;

a circuit substrate for transmitting a driving signal to said driving element substrate;

a base member for arranging said recording element substrate and said driving element substrate; and a pressure contact member for pressure contacting said recording element substrate through a first of said plurality of electrical connecting members with said driving element substrate and for pressure contacting said circuit substrate through a second of said plurality of electrical connecting members with said driving element substrate; and means for mounting said recording element driving unit.

23. A recording element driving unit comprising:

a plurality of electrical connecting members each having a support member of an electrically insulating material and a plurality of electroconductive members arranged on said support member, each said electroconductive member having one end exposed on one surface of said support member and another end exposed on another surface of said support member;

a recording element substrate having thereon a plurality of recording elements connected to said electroconductive members;

a driving element substrate having thereon a plurality of driving elements, each said driving element having connecting portions and said plurality of driving elements being larger in number than a number of driving elements electrically connected to said plurality of recording elements and fewer in number than said plurality of electroconductive members, said driving element connecting portions being disposed at a pitch larger than a pitch at which said plurality of electroconductive members are arranged, wherein each said driving element connecting portion is electrically connected to the other exposed end of at least one said electroconductive member;

a base member for arranging said recording element substrate and said driving element substrate;

a circuit substrate to which said recording element substrate is connected through a first one of said electrical connecting members and to which said driving element substrate is connected through a second one of said electrical connecting members on a surface of said circuit substrate where a wiring pattern is formed; and a pressure contact member for pressure contacting said circuit substrate with said recording element substrate, and said circuit substrate with said driving element substrate, respectively, through said electrical connecting members.

24. A recording element driving unit comprising:

a plurality of electrical connecting members each having a support member of an electrically insulating material and a plurality of electroconductive members arranged on said support member, each said electroconductive member having one end exposed on one surface of said support member and another end exposed on another surface of said support member;

a recording element substrate having thereon a plurality of recording elements connected to said electroconductive members;

a driving element substrate having thereon a plurality of driving elements, each said driving element having connecting portions and said plurality of driving elements being larger in number than a number of driving elements electrically connected to said plurality of recording elements and fewer in number than said plurality of electroconductive members, said driving element connecting portions being disposed at a pitch larger than a pitch at which said plurality of electroconductive members are arranged, wherein each said driving element connecting portion is electrically connected to the other exposed end of at least one said electroconductive member;

a circuit substrate for transmitting a driving signal to said driving element substrate;

a base member for arranging said recording element substrate and said driving element substrate; and a pressure contact member for pressure contacting said recording element substrate through a first of said plurality of electrical connecting members with said driving element substrate and for pressure contacting said circuit substrate through a second of said plurality of electrical connecting members with said driving element substrate.

* * * * *